US008818221B2

(12) United States Patent
Ogino et al.

(10) Patent No.: US 8,818,221 B2
(45) Date of Patent: Aug. 26, 2014

(54) TRANSFER DEVICE AND IMAGE FORMING APPARATUS

(75) Inventors: Yasuhiko Ogino, Kanagawa (JP); Haruo Iimura, Kanagawa (JP); Shinji Aoki, Kanagawa (JP); Keigo Nakamura, Kanagawa (JP); Masahide Nakaya, Kanagawa (JP); Tomokazu Takeuchi, Tokyo (JP); Shinya Tanaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 60 days.

(21) Appl. No.: 13/406,041

(22) Filed: Feb. 27, 2012

(65) Prior Publication Data

US 2012/0230715 A1 Sep. 13, 2012

(30) Foreign Application Priority Data

Mar. 9, 2011 (JP) ..... 2011-051289
Dec. 6, 2011 (JP) ..... 2011-266684

(51) Int. Cl.
*G03G 15/20* (2006.01)

(52) U.S. Cl.
USPC ..... 399/66; 399/88; 399/122; 399/297; 399/314

(58) Field of Classification Search
USPC ..... 399/66, 88, 122, 297, 302, 314
See application file for complete search history.

(56) References Cited

U.S. PATENT DOCUMENTS 4,962,307 A 10/1990 Nakaya
5,132,869 A 7/1992 Nakaya
5,142,329 A 8/1992 Nakaya
5,595,852 A 1/1997 Shimoda et al.
6,284,424 B1 9/2001 Iimura et al.
6,405,000 B1 6/2002 Nakaya
7,127,189 B2 10/2006 Takamatsu et al.
7,236,714 B2 6/2007 Sato et al.
7,269,368 B2 9/2007 Sato et al.
7,561,835 B2 7/2009 Tanaka et al.
7,579,716 B2 8/2009 Sato et al.
7,653,339 B2 1/2010 Yamashita et al.
7,662,530 B2 2/2010 Iimura
7,693,440 B2 4/2010 Sato et al.
7,720,418 B2 5/2010 Tanaka et al.

(Continued)

FOREIGN PATENT DOCUMENTS

JP 9-146381 6/1997
JP 2003-118158 4/2003

(Continued)

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

Described herein is a transfer device that transfers a visualized image formed on an image carrier onto a recording medium. The transfer device includes an image carrier that carries a toner image, a contacting member that contacts the image carrier via a recording medium and a power source that outputs a transfer bias to transfer the toner image from the image carrier onto the recording medium at a transfer nip formed between the image carrier and the contacting member. The transfer bias has a direct current component and an alternating current (AC) component superimposed on the direct current component. The transfer device also includes a controller that controls the power source such that the controller controls a level of the direct current component output from the power source by a constant current control.

19 Claims, 15 Drawing Sheets

(56) References Cited

U.S. PATENT DOCUMENTS

| | | | | |
|---|---|---|---|---|
| 7,738,819 | B2 | 6/2010 | Honda et al. | |
| 7,913,098 | B2 | 3/2011 | Nakaya et al. | |
| 7,941,087 | B2 | 5/2011 | Tanaka et al. | |
| 7,970,334 | B2 | 6/2011 | Yamashita et al. | |
| 7,979,017 | B2 | 7/2011 | Tanaka et al. | |
| 7,991,342 | B2 | 8/2011 | Kabata et al. | |
| 8,041,276 | B2 | 10/2011 | Ogino | |
| 8,045,875 | B2 | 10/2011 | Aoki et al. | |
| 8,080,096 | B2 | 12/2011 | Yamashita et al. | |
| 8,081,916 | B2 | 12/2011 | Tanaka et al. | |
| 8,081,917 | B2 | 12/2011 | Nakai et al. | |
| 8,107,872 | B2 | 1/2012 | Ozaki et al. | |
| 2005/0189923 | A1 | 9/2005 | Ohishi et al. | |
| 2007/0059016 | A1 | 3/2007 | Sato et al. | |
| 2007/0178398 | A1 | 8/2007 | Ogino et al. | |
| 2008/0187857 | A1 | 8/2008 | Ogino et al. | |
| 2009/0142087 | A1 | 6/2009 | Iimura | |
| 2010/0034560 | A1 | 2/2010 | Tanaka et al. | |
| 2010/0054829 | A1 | 3/2010 | Iio et al. | |
| 2010/0098446 | A1 | 4/2010 | Ishikawa et al. | |
| 2010/0183972 | A1 | 7/2010 | Hasegawa et al. | |
| 2010/0209143 | A1 | 8/2010 | Nakai et al. | |
| 2010/0232820 | A1* | 9/2010 | Usami et al. | 399/66 |
| 2010/0239309 | A1 | 9/2010 | Tanaka et al. | |
| 2010/0284705 | A1* | 11/2010 | Aoki et al. | 399/66 |
| 2010/0303518 | A1* | 12/2010 | Aimoto et al. | 399/314 |
| 2010/0310291 | A1 | 12/2010 | Tanaka et al. | |
| 2010/0329707 | A1* | 12/2010 | Yamada | 399/44 |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0058831 | A1 | 3/2011 | Usami et al. | |
| 2011/0131434 | A1 | 6/2011 | Nakaya | |
| 2011/0181116 | A1 | 7/2011 | Takeuchi et al. | |
| 2011/0200348 | A1 | 8/2011 | Aoki | |
| 2011/0206399 | A1* | 8/2011 | Fujita et al. | 399/49 |
| 2011/0229168 | A1 | 9/2011 | Shiraishi et al. | |
| 2011/0255892 | A1 | 10/2011 | Aoki | |
| 2012/0045231 | A1 | 2/2012 | Ogino et al. | |
| 2012/0045237 | A1* | 2/2012 | Aoki et al. | 399/66 |
| 2012/0045259 | A1 | 2/2012 | Nakamura et al. | |

FOREIGN PATENT DOCUMENTS

| | | | |
|---|---|---|---|
| JP | 3791386 | B2 | 6/2006 |
| JP | 2006-267486 | | 10/2006 |
| JP | 3918545 | | 2/2007 |
| JP | 2008-58585 | | 3/2008 |

* cited by examiner

TRANSFER DEVICE AND IMAGE FORMING APPARATUS

CROSS-REFERENCE TO RELATED APPLICATIONS

The present application claims priority to and incorporates by reference the entire contents of Japanese Patent Application No. 2011-051289 filed in Japan on Mar. 9, 2011 and Japanese Patent Application No. 2011-266684 filed in Japan on Dec. 6, 2011.

BACKGROUND OF THE INVENTION

1. Field of the Invention

The present invention relates a transfer device that transfers a visualized image formed on an image carrier onto a recording medium, and an image forming apparatus including the transfer device.

2. Description of the Related Art

An electrophotographic image forming apparatus forms an image by visualizing a charged latent image obtained by imaging optical image information onto an image carrier that has been evenly charged in advance, using toner supplied from a developing unit, and by transferring and fixing the image which is thus visualized onto a recording sheet (recording medium). In such an image forming apparatus, because a recording sheet has some texture, toner is less easily transferred onto recessed parts than projected parts. In particular, when toner is to be transferred onto a recording sheet with a highly textured surface, the toner might not be transferred well onto recessed parts, and might result in white splotches in the image.

As a countermeasure for this issue, Japanese Patent Application Laid-open No. 2006-267486, Japanese Patent Application Laid-open No. 2008-058585, and Japanese Patent Application Laid-open No. H9-146381, for example, describe technologies for improving a transfer ratio by superimposing an alternating current (AC) voltage on a direct current (DC) voltage.

The technology disclosed in Japanese Patent Application Laid-open No. 2006-267486 performs control using an AC voltage superimposed on a DC voltage as a transfer bias, and charging the surface of a recording sheet to the opposite polarity of that of the toner in a manner suitable for the texture before transferring the image so that toner is to be transferred to recessed parts.

The technology disclosed in Japanese Patent Application Laid-open No. 2008-058585 uses an AC voltage superimposed on a DC voltage as a transfer bias. The AC voltage is superimposed in a manner making the voltage between peaks of the AC voltage equal to or less than twice the DC voltage.

The technology disclosed in Japanese Patent Application Laid-open No. H9-146381 uses fluorine resin on the surface of an intermediate transfer element, and uses an AC voltage superimposed on a DC voltage as a transfer bias. The AC voltage is superimposed in a manner making the voltage between peaks of the AC voltage equal to or more than 2.05 times the DC voltage.

Although all of these technologies attempt to improve transferability by controlling voltages applied from the DC power source and the AC power source to the target values, detailed descriptions in these disclosures merely disclose the relations between the transfer voltage and the transferability.

In a transfer device for improving the toner transferability by superimposing a DC voltage on an AC voltage and applying the resultant voltage to recessed parts of textured paper, depending on the output AC voltage and DC voltage, the density in smooth parts, the transferability in the recessed parts, and abnormalities of images resulting from discharge may vary. Therefore, the AC voltage setting and the DC voltage setting need to be kept within a certain range. However, it is also necessary to change the ranges of the AC voltage setting and the DC voltage setting depending on a change in the resistance in the transfer member caused by environmental changes, e.g., a change in temperature or humidity, or depending on the type of a paper sheet that is a recording medium. In the method in which a DC voltage is superimposed on an AC voltage and the resultant voltage is applied, the acceptable ranges of the voltage settings are more limited for the aforementioned reason than those in a conventional transfer device applying only a DC voltage. Furthermore, the relation between the DC voltage, the AC voltage, and the resultant image is complex. Therefore, it is difficult to cope with resistance changes and different types of paper sheets.

There is a need to address the issue described above in conventional transfer units, and an object of the present invention is to provide a transfer unit and an image forming apparatus that improve the transfer ratio to the recessed parts on a textured surface of a paper sheet, that can transfer toner evenly even to a paper sheet having a highly textured surface, and that can output high quality images in a stable manner even in environmental changes and for different types of paper sheets.

SUMMARY OF THE INVENTION

It is an object of the present invention to at least partially solve the problems in the conventional technology.

According to an embodiment, a transfer device includes: an image carrier from which an image is transferred onto a transfer medium using electrostatic toner, the image carrier being applied with a direct current voltage superimposed with an alternating current (AC) voltage as a transfer bias. An output voltage of a power source for applying the voltage is controlled so that a current level of a direct current component output from the power source is kept at a specified current level.

According to another embodiment, an image forming apparatus includes the transfer device mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment will now be explained with reference to drawings.

Figure 1:
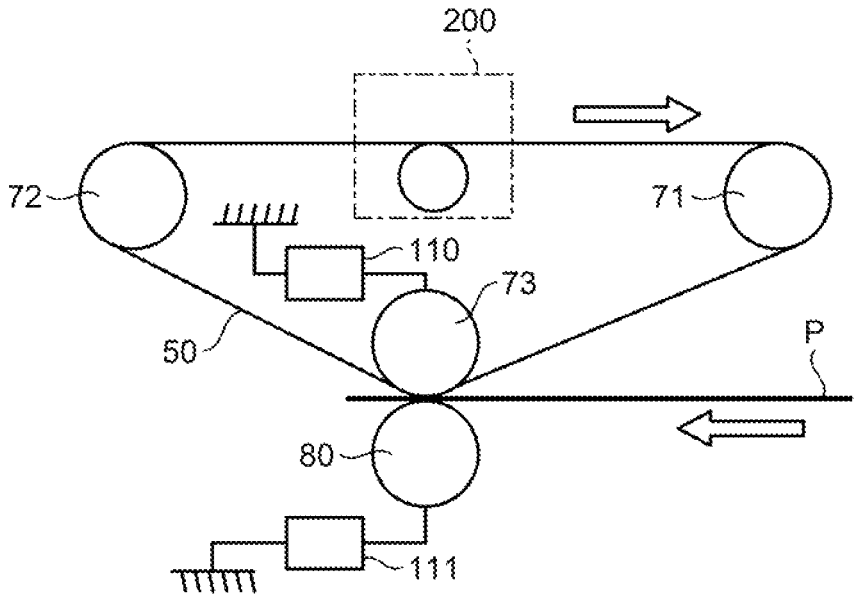
FIG. 1 is a schematic illustrating an exemplary structure of a transfer unit according to the embodiment.

FIG. 1 is a schematic illustrating an exemplary structure of a transfer unit according to the embodiment. In FIG. 1, the reference numeral 200 indicates an image forming unit or an image transfer unit. The reference numeral 50 indicates an image carrier such as a photosensitive element or an intermediate transfer element that carries a toner image. The toner image formed on the image carrier 50 is conveyed in the direction of an arrow. A transfer medium P is conveyed from a feeding device not illustrated into a nip between the image carrier 50 and a transfer member (or, a transfer roller) 80 in the direction of an arrow (from the right side in FIG. 1) at predetermined operational timing. At this time, the toner image formed on the image carrier 50 is electrostatically transferred onto the transfer medium P that is recording medium. At this time, a transfer voltage is applied from any one of a power source 110 and a power source 111 or both so that an electrical field is generated by the DC component in a direction causing the toner on the image carrier 50 to be transferred onto the transfer medium P. In the exemplary structure illustrated, a voltage is applied from the power source 111 to the transfer member 80, and a voltage is applied from the power source 110 to a facing member (or, a facing roller) 73.

At this time, the voltage being applied is a DC voltage superimposed on an AC voltage. The DC/AC superimposed voltage may be applied from either one of the power source 110 and the power source 111, or the AC and the DC may be applied separately from the power source 110 and the power source 111. The AC/DC superimposed voltage may be applied from one of the power source 110 and the power source 111, and the DC voltage may be applied from the other. By providing an output voltage having only the DC component and an AC/DC superimposed voltage in a selectable manner, these voltages can be switched depending on conditions. For example, if the transfer medium P is a recording medium without any texture, the power source may be switched so as to apply only the DC component.

In this manner, in applications not requiring any AC voltage, the transfer unit may be used with a DC component only, in the same manner as in a conventional transfer unit so that the energy can be saved. In such a case, the power source for applying the AC/DC superimposed voltage may be provided in singularity and is caused to apply only the DC component by causing not to supply the AC component. Alternatively, separate power circuits may be provided for application of the DC voltage and application of the AC/DC superimposed voltage, and be switched when the voltages are to be switched.

The latter configuration can achieve some advantageous effects. For example, a power circuit for applying an AC/DC superimposed voltage can simply be added to an existing transfer unit that applies only the DC voltage, with some upgrade of functions, and development time can be shortened by making some adjustments to the existing system. If the AC power source and the DC power source are arranged separately in the same manner as the power source 110 and the power source 111 illustrated in FIG. 1 and arranged on the side of the facing member 73 and on the side of the transfer member 80, respectively, the space in the housing can be saved so that the unused space can be utilized for other functions, or the apparatus can be reduced in size.

Figure 2:
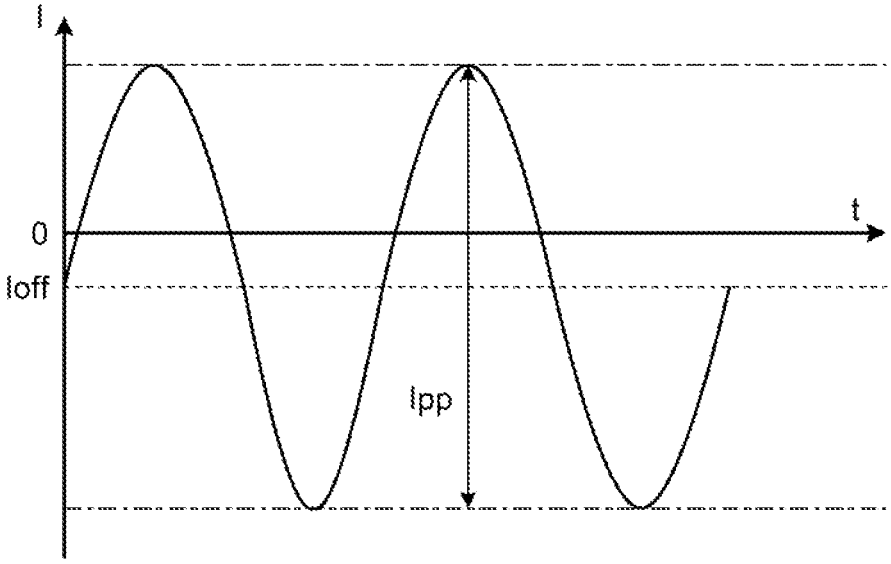
FIG. 2 is a graph illustrating an example of measurements of a current flowing from a power source to a facing member.

FIG. 2 is a graph illustrating an example of measurements of a current flowing from the power source 110 to the facing member 73. In this embodiment, the voltage output from the power source is controlled so that the current Ioff of the DC component is kept at a specified level, or both of Ioff and Ipp that is a current level between the peaks of the AC component are kept at specified levels. Hereinafter, in a voltage application method in which the DC voltage is superimposed on the AC voltage before being applied, referred to as a constant current control is controlling the output voltage in a manner keeping the DC component (offset current) Ioff in the output current at a predetermined level, or in a manner keeping the current Ipp between peaks of the AC component at a predetermined level. On the contrary, referred to as a constant voltage control is controlling the output voltage in a manner keeping the DC component Voff in the output voltage at a predetermined level, or keeping the voltage Vpp between peaks of the AC component at a predetermined level.

When the constant voltage control is performed to the output voltage, high transferability cannot be achieved unless the applied voltage is changed greatly depending on resistance changes in the member caused by humidity, or types of the recording medium. On the contrary, when the constant current control is performed, the transferability varies less in the face of such changes. Detailed data indicating advantages of the constant current control over the constant voltage control will be provided in an embodiment of an image forming apparatus to be explained later.

Figure 3:
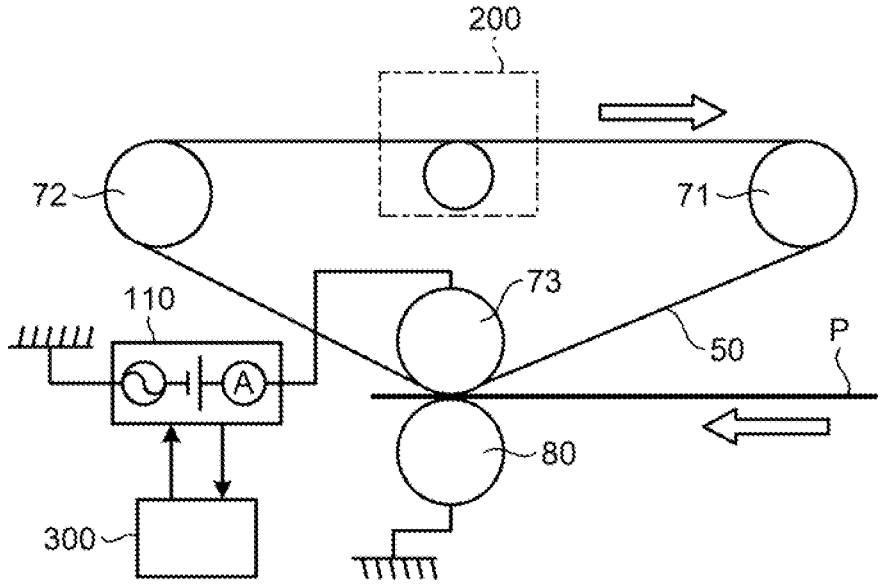
FIG. 3 is a schematic illustrating a structure according to an embodiment in which a constant current control is performed to an output voltage.

FIG. 3 is a schematic illustrating a structure according to an example in which the constant current control is performed to the output voltage using Ioff (second embodiment). Explanations that are redundant with those in the first embodiment illustrated in FIG. 1 will be omitted herein, and only differences will be explained. In the structure illustrated in FIG. 3, the transfer member 80 is grounded, and a voltage is applied from the power source 110 to the facing member 73. The power source 110 is controlled by a control circuit 300.

In such a structure, Ioff is detected by an ammeter arranged internally to the power source 110, and is input to the control circuit 300. A controlling signal is input from the control circuit 300 to the power source 110. The control circuit 300 outputs the controlling signal based on a current setting, and the voltage output from the power source 110 is adjusted so that the output Ioff is kept at the level specified by the current setting. The constant current control may be performed to Ipp in the same manner. According to a research made by the inventors of the embodiment, Ioff represents movements of electrical charges caused by movement of the toner or discharge. Therefore, Ioff setting can be established using the current generated by the toner movement as a guideline. The current Itoner generated by the toner movement can be expressed in a relation represented by Equation (1) below.

$$Itoner = v*W*Q/M*M/A*10 \quad (1)$$

where, v represents a velocity [m/s] of the transfer medium P, W represents the width [meters] of the image in the axial direction of the roller, Q/M represents the electric charge [μC/g] of the toner, and M/A represents the amount of attached toner [mg/cm$^2$].

For values of the image width and the amount of toner attached, maximum values that are assumed when a solid black image is transferred onto a recording medium are used so as to allow all toner to be transferred. For example, when v=0.3 [m/s], W=0.3 [meters], Q/M=−30 [μC/g], and M/A=0.5 [mg/cm$^2$], Itoner=−13.50 [μA, or microamperes]. At this time, the absolute value of Ioff is preferably set to a value equal to or more than |Itoner|, for example, Ioff=−20 [microamperes]. The setting for Ioff when a different velocity v of the transfer medium P is used can be obtained by calculating Itoner from Equation (1) above. For example, because Ioff=−6.75 [microamperes] when v=0.15[m/s], Ioff is set to be Ioff=−10 [microamperes].

When the velocity (linear velocity) is to be changed depending on transfer media, different modes for automatically switching Ioff depending on velocities may be configured to achieve the stable image quality for different transfer medium velocities. Furthermore, for a color image having a higher M/A than a monochromatic image, Ioff setting can be estimated from Equation (1) as well. For example, assuming that M/A of a color image is 1.0 [mg/cm$^2$] that is twice that of a monochromatic image, Ioff may be set to −40 [microamperes] that is twice that for a monochromatic image. By providing a color print mode for automatically switching Ioff setting based on image information being output, a stable image can be obtained for both of color images and monochromatic images.

Ipp is required to be at a level that can produce an electrical field that enables the toner to be transferred onto the recessed parts. If Ipp is too low, the toner is not transferred onto the recessed parts. This level differs depending on the resistance in the transfer member and the width of the transfer nip. In this example, Ipp is set to 3.0 [milliamperes] as an example. By setting Ipp to an appropriate value, high transferability to the recessed parts can be maintained for different types of a transfer medium P.

The shape of the transfer member 80 is not especially limited, as long as the AC/DC superimposed electrical field can be applied in the transfer nip. However, the shape of a roller is preferable from the viewpoint of reducing the frictional force. The transfer member 80 may be structured to have a conductive core metal having the shape of a cylinder, and a surface layer made of resin or rubber laid on the outer circumferential surface of the core metal. Various materials may be used for the transfer medium P that is a recording medium, such as paper, resin, and metal. In this embodiment, the waveform of the AC voltage is a sine wave, but may be other waveforms such as a rectangular wave.

The power circuit of the transfer unit will now be explained in detail.

Figure 4:
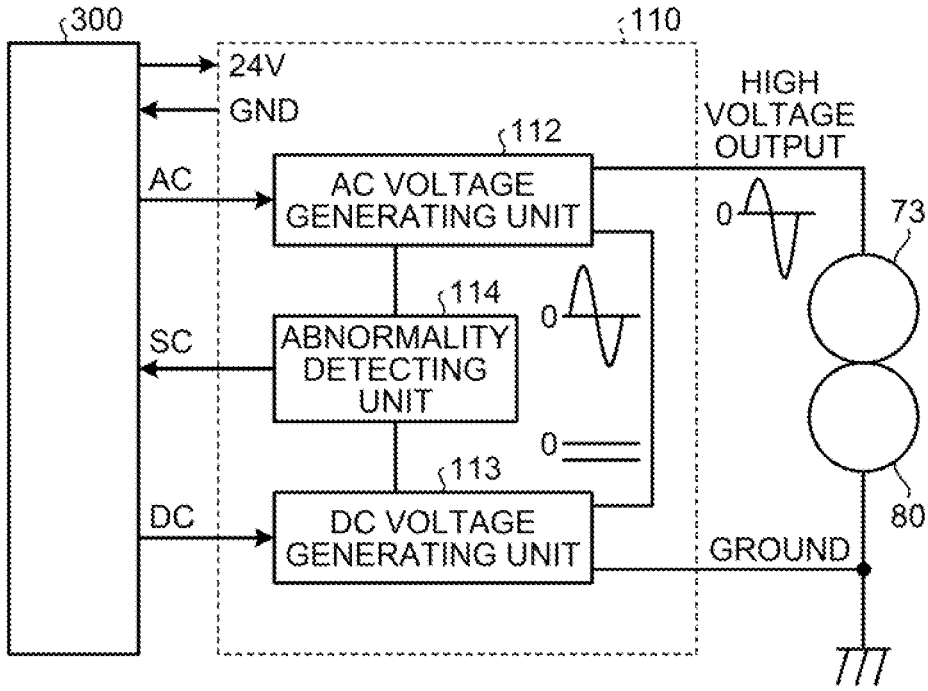
FIG. 4 is a block diagram illustrating an exemplary configuration of a power source for generating an AC/DC superimposed voltage.

FIG. 4 is a block diagram illustrating an exemplary configuration of the power source 110 for generating the AC/DC superimposed voltage. As illustrated in FIG. 4, the power source 110 includes an AC voltage generating unit 112 and a DC voltage generating unit 113 that are connected serially, and are connected between the facing roller 73 and the transfer member 80 acting as a load. The transfer medium P and the image carrier 50 are not illustrated in FIG. 4. A power 24V and GND for driving the power source 110 are supplied from the control circuit 300 via an interlock switch not illustrated. Initiating signals AC and DC are respectively supplied to the AC voltage generating unit 112 and the DC voltage generating unit 113. An abnormality detecting unit 114 is connected to the AC voltage generating unit 112 and the DC voltage generating unit 113, and outputs a signal SC indicating a detection of an output power abnormality to the control circuit 300. In this configuration, a DC voltage superimposed on an AC voltage is applied to the load.

Figure 5:
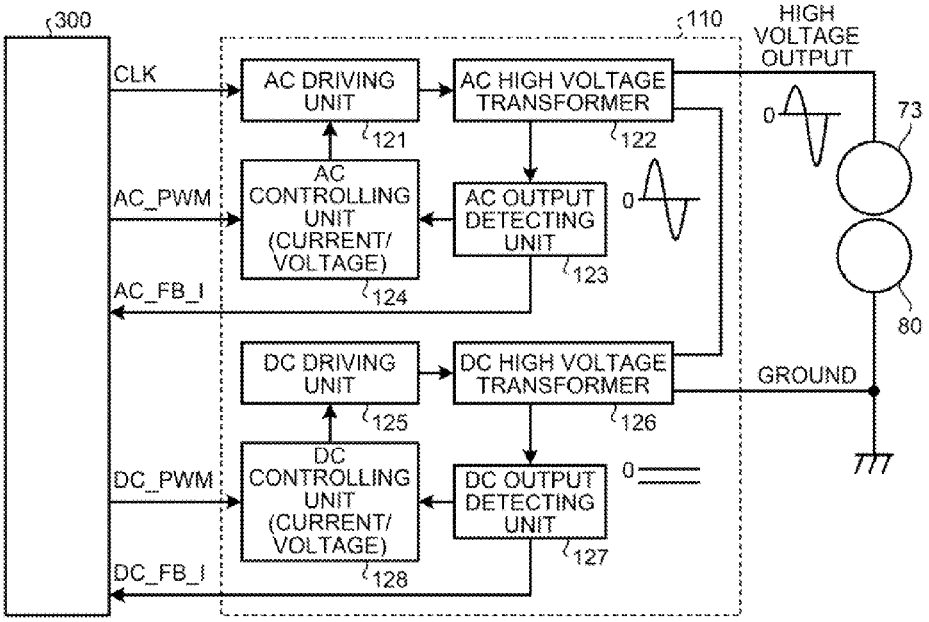
FIG. 5 is a block diagram illustrating another exemplary configuration of the power source for generating the AC/DC superimposed voltage.

FIG. 5 is a block diagram illustrating another example of the configuration of the power source 110 generating the AC/DC superimposed voltage (an example other than that illustrated in FIG. 4). In FIG. 5, an AC voltage generating unit includes an AC driving unit 121, an AC high voltage transformer 122, an AC output detecting unit 123, and an AC controlling unit 124. A DC voltage generating unit includes a DC driving unit 125, a DC high voltage transformer 126, a DC output detecting unit 127, and a DC controlling unit 128. The abnormality detecting unit and the 24V input and GND output from the control circuit 300 for operating the power source 110 are not illustrated in FIG. 5.

In such a configuration, a signal CLK for setting the frequency of the AC voltage is supplied from the control circuit 300. A signal AC_PWM for setting the current or the voltage of the AC output and a signal AC_FB_I for monitoring the AC output are also connected. A signal DC_PWM for setting the current or the voltage of the DC output that is superimposed on the AC output and a signal DC_FB_I for monitoring the DC output are connected to the DC generating unit as well. Blocks for controlling the AC and the DC (current/voltage) output signals for controlling driving of the high voltage transformers 122 and 126 via the AC driving unit 121 and the DC driving unit 125, respectively, so that a detected signal output from each of the output detecting units 123 and 127 is kept at a predetermined level, based on instructions from the control circuit 300.

In the AC control, to enable both of the constant current control and the constant voltage control, both of the current and the voltage of the AC output are controlled, and the AC output detecting unit 123 detects both of the output current and the output voltage. The same can be said for the DC control. In this embodiment, both of the AC and the DC are usually controlled in a manner prioritizing the detected current so that the constant current control is performed. The detected output voltage is used to suppress the voltage to the upper boundary, and is used for controlling the maximum voltage when no load is applied, for example. The monitoring signals respectively output from the AC output detecting unit 123 and the DC output detecting unit 127 are input to the control circuit 300 as load monitoring information.

The frequency of the AC voltage is set with reference to the signal CLK output from the control circuit 300. However, the AC voltage generating unit may generate a fixed frequency internally.

Figure 6:
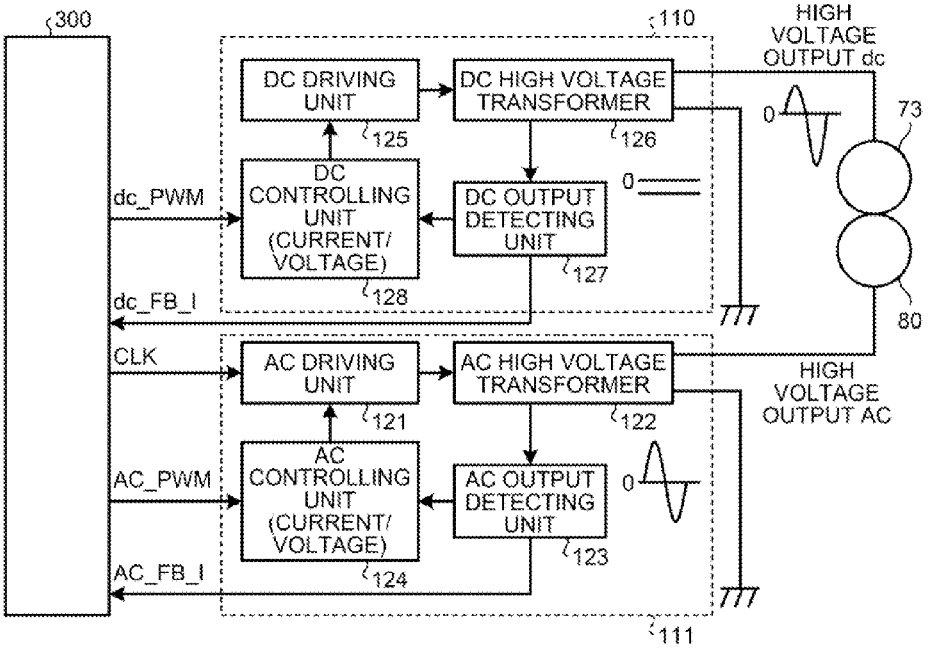
FIG. 6 is a block diagram of an exemplary configuration of a power source in which a DC voltage is applied from one power source, and an AC voltage is applied from the other power source.

FIG. 6 illustrates an exemplary configuration of a power source in which the DC voltage is applied from the one power sources 110, and only the AC voltage is applied from the other power source 111. By causing the power source 110 and the power source 111 to output simultaneously, the function achieved by the configuration illustrated in FIG. 5 is realized.

In addition, only the power source 110 may be caused to output. In this manner, it is possible to select either a conventional secondary transfer using only the DC component or a secondary transfer using the AC/DC superimposed voltage. The units included in the power sources 110 and 111 have the same functions as those illustrated in FIG. 5. Therefore, explanations thereof are omitted.

Figure 7:
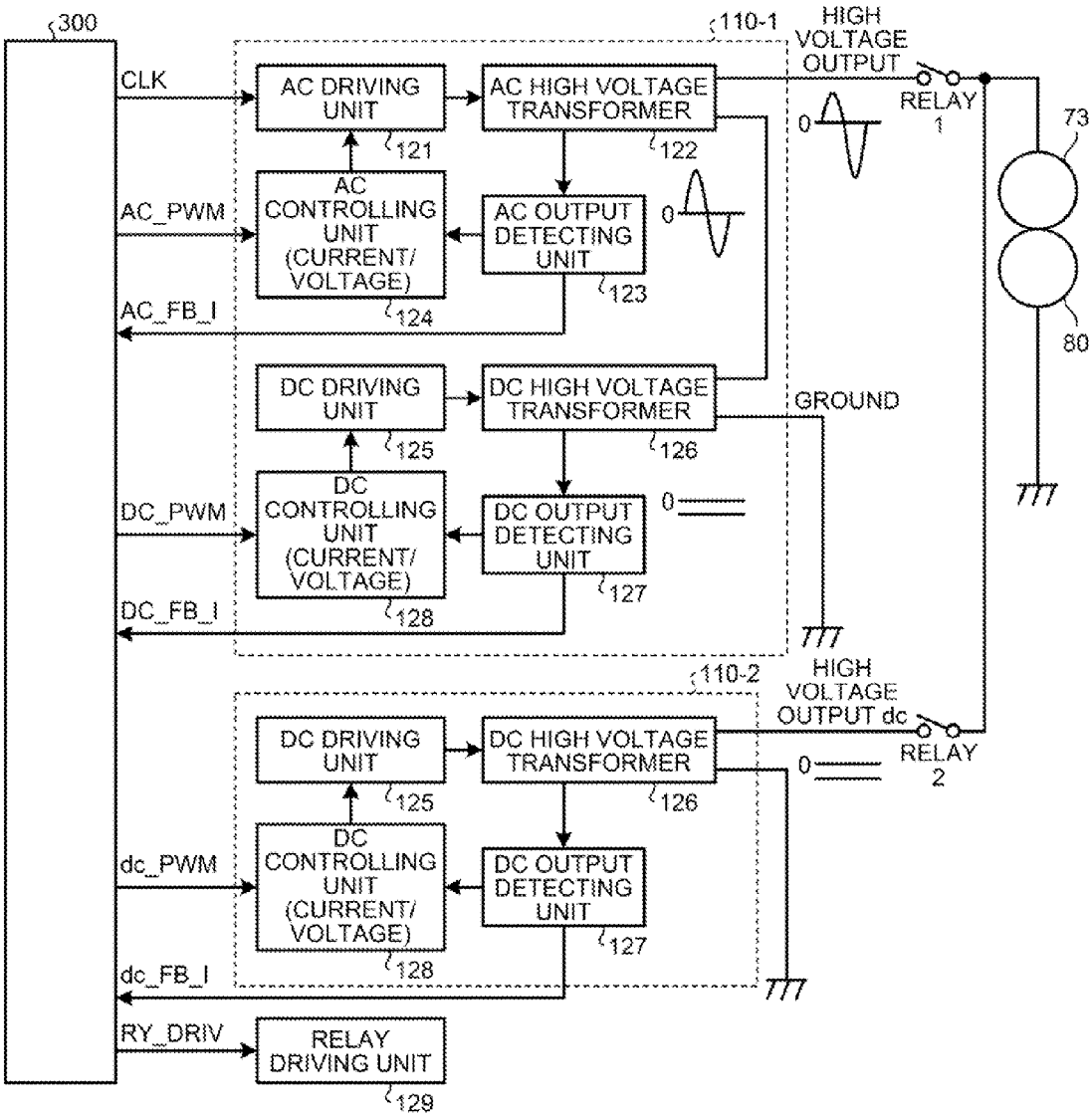
FIG. 7 is a block diagram of another exemplary configuration in which a secondary transfer using only the DC component and a secondary transfer using application of the AC/DC superimposed voltage can be selected.

FIG. 7 illustrates another exemplary configuration in which the secondary transfer using only the DC component and the secondary transfer using application of the AC/DC superimposed voltage can be selected, in the same manner as in the configuration illustrated in FIG. 6. In this exemplary configuration, a relay 1 and a relay 2 that are switching units are used to switch a voltage to be applied to the facing roller 73. The AC/DC superimposed voltage is generated in a power source 110-1, and the conventional voltage having only the DC component is generated in a power source 110-2. To control application of the voltage to the transfer unit using the relays, a controlling signal is passed between the control circuit 300 and each of the power sources 110-1 and 110-2, and a relay driving unit 129 is also added so that switching can be controlled with a controlling signal RY_DRIV.

Figure 8:
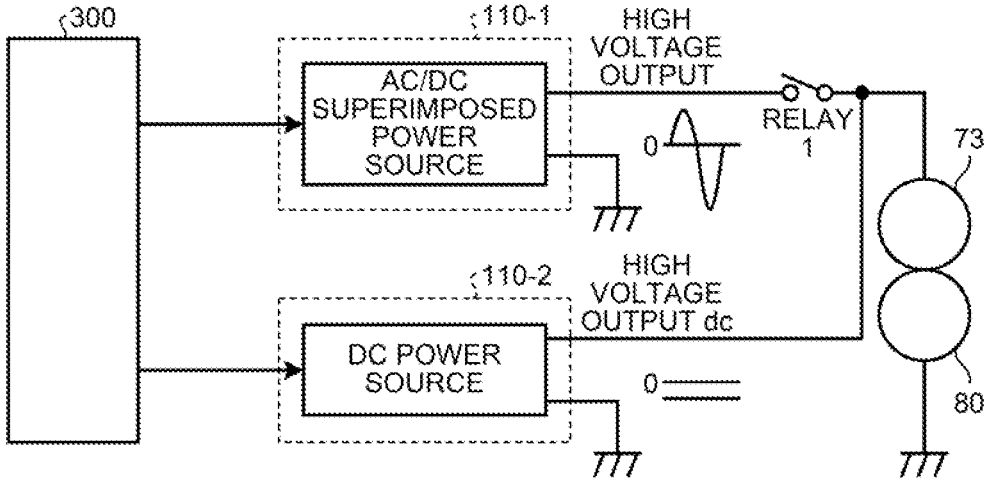
FIG. 8 is a block diagram illustrating another example of the configuration in which the secondary transfer using only the DC component and the secondary transfer using application of the AC/DC superimposed voltage can be selected.

FIG. 8 illustrates another example of a configuration in which the secondary transfer using only the DC component and the secondary transfer using application of the AC/DC superimposed voltage can be selected, in the same manner as the configuration illustrated in FIG. 7. In this exemplary configuration, the relay 1 that is a switching unit is arranged only at the output of the power source 110-1. The output side of the relay 1 is connected to the other power source 110-2. Therefore, when the contact of the relay 1 is closed and the AC/DC superimposed voltage is output from the power source 110-1, the voltage is also applied to the power source 110-2 that is connected in parallel with the transfer unit. In this case, the power source 110-2 also acts as a load to the power source 110-1. This configuration enables the circuit to be simplified in a situation where the transfer unit is not affected even if the current is supplied to the power source 110-2. Therefore, the same function can be realized in a simpler and a more inexpensive manner.

Figure 9:
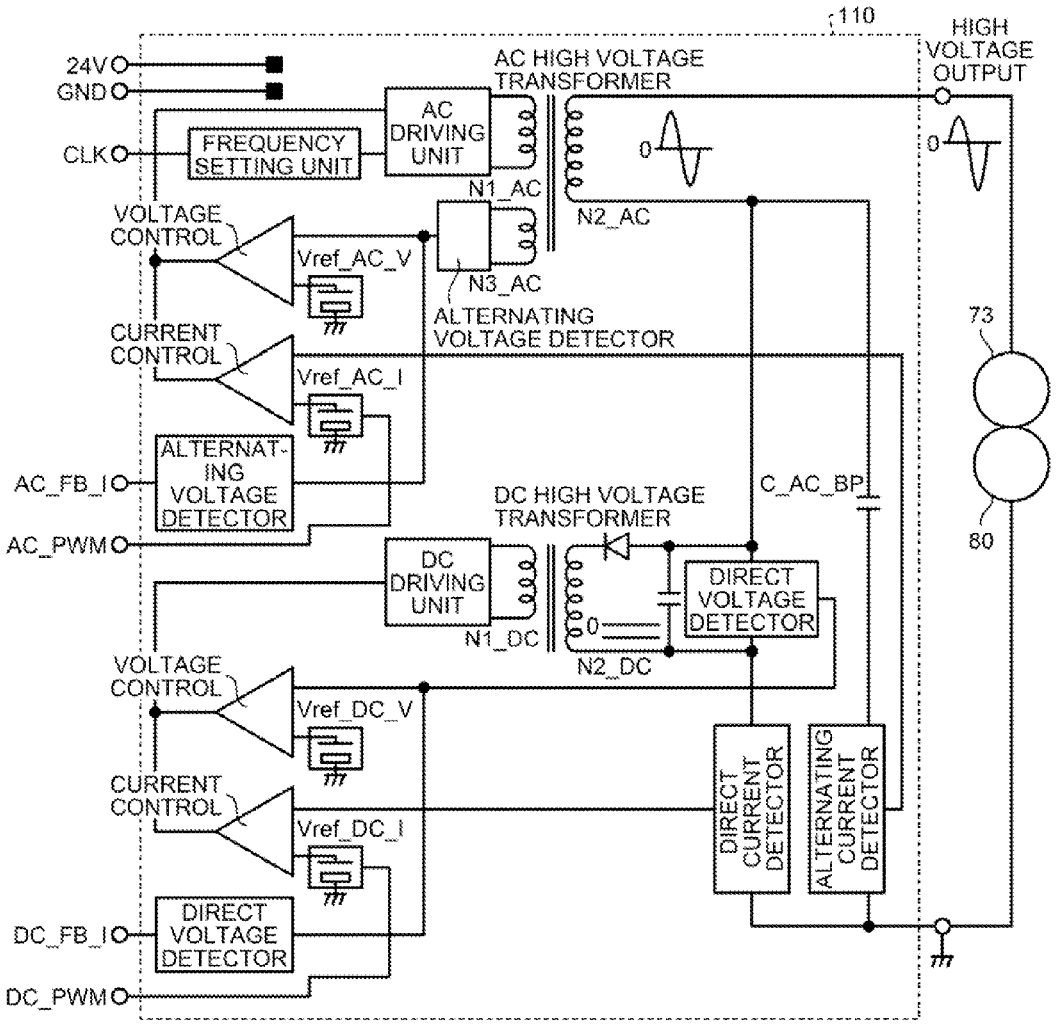
FIG. 9 is a simplified circuit diagram illustrating a specific configuration of the power source illustrated in FIG. 5.

FIG. 9 is a simplified circuit diagram illustrating a specific configuration of the power source 110 illustrated in FIG. 5.

The constant current control is performed in both of the AC voltage generating unit 112 illustrated in the upper half and the DC voltage generating unit 113 illustrated in the lower half. For the voltage of the AC, a coil N3_AC is used to take out a low voltage that approximates the output of the high voltage transformer, and the voltage controlling comparator is used to compare the voltage thus taken out with a reference signal Vref_AC_V. The current of the AC is taken out by an alternating current detector arranged between the ground and a capacitor C_AC_BP for biasing the AC component and connected in parallel with the output of the DC voltage generating unit, and a current controlling comparator is used to compare the alternating current with a reference signal Vref_AC_I. The level of the reference signal Vref_AC_I is set based on the signal AC_PWM for setting the level of the AC output current.

The level of the reference signal Vref_AC_V is set so that the output of the voltage controlling comparator is valid when the output voltage increases to a predetermined level or higher (for example, when no load is applied). The level of the reference signal Vref_AC_I is set so that the output of the current controlling comparator is valid while the load is at a usual level. In this manner, high voltage output currents can be switched correspondingly to conditions of the load (e.g., the facing roller 73, the transfer member 80, and the member between the rollers). The outputs of the voltage controlling comparator and the current controlling comparator are input to the AC driving unit, and the AC high voltage transformer is driven based on the levels of these comparator outputs.

In the DC voltage generating unit as well, both of the output voltage and the output current are detected. The voltage is detected by a DC voltage detector connected in parallel with a rectifying/smoothing circuit arranged at an output coil N2_DC of the high voltage transformer. The current is detected and taken out by a direct current detector connected between the output coil and the ground. The voltage detection signal and the current detection signal are respectively compared with a reference signal Vref_DC_V and a reference signal Vref_DC_I that are weighted in the same manner as for the AC, and used to control the DC component in the high voltage output.

An image forming apparatus according to the embodiment is now to be explained. The effectiveness of the constant current control will be then explained specifically using the results of a research conducted using such an image forming apparatus. The embodiment of the image forming apparatus is merely an example. The effects of the embodiment remain the same even if the configurations or processing conditions are changed, by using different types of image forming apparatuses and various image formation environments.

Figure 10:
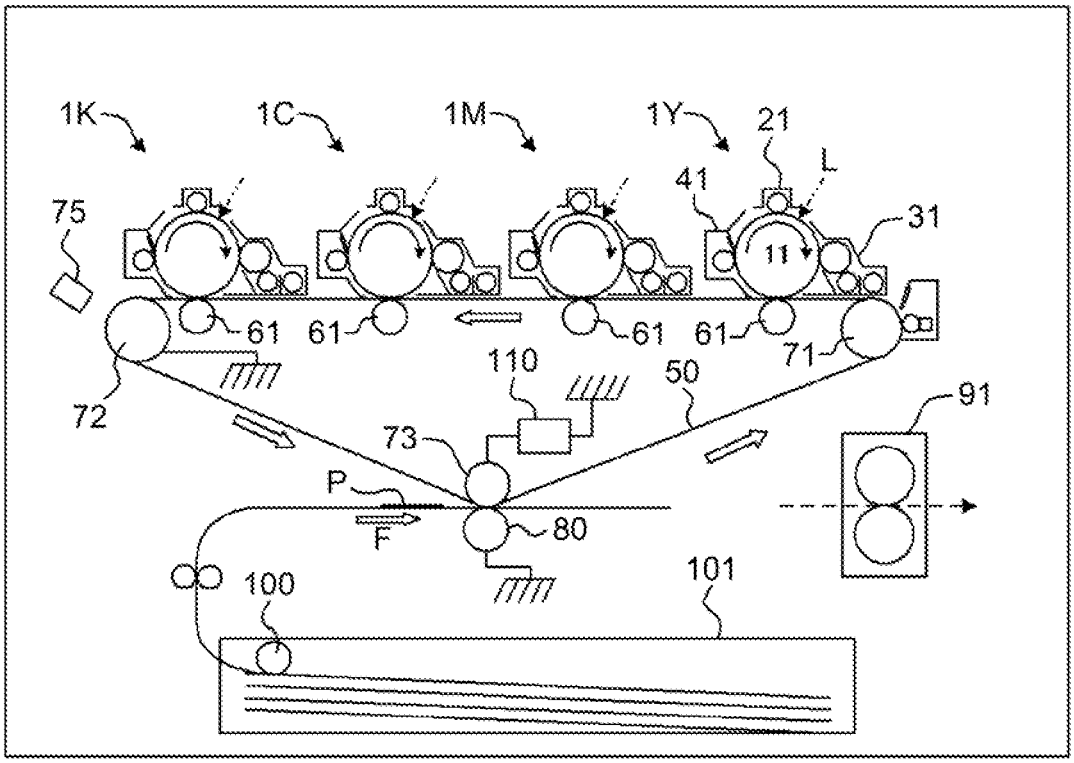
FIG. 10 is a sectional view generally illustrating a structure of a color image forming apparatus that is an example of the image forming apparatus according to the embodiment.

FIG. 10 is a sectional view generally illustrating a structure of a color image forming apparatus (hereinafter, simply referred to as a printer) that is an example of the image forming apparatus according to the embodiment. The printer according to the embodiment is an image forming apparatus that forms an image by superimposing images in four color components of yellow (Y), magenta (M), cyan (C), and black (K). In this embodiment, image forming units 1Y, 1M, 1C, and 1K respectively corresponding to the colors of yellow, magenta, cyan, and black are arranged in the manner illustrated in FIG. 10. A toner image formed in each of the colors on each of photosensitive elements 11 (11Y, 11M, 11C, and 11K) that are image carriers included in the image forming units 1Y, 1M, 1C, and 1K is sequentially transferred onto an intermediate transfer element (intermediate transfer belt 50) having the form of a belt that is arranged in a manner abutting against the photosensitive elements. The toner images transferred onto the intermediate transfer belt 50 are further transferred onto a recording sheet that is fed from a paper cassette 101 via a paper feeding roller 100. Specifically, the recording sheet fed from the paper cassette is conveyed into the nip between the intermediate transfer belt 50 and the secondary transfer roller 80 in the direction of the arrow F at a predetermined operational timing. At this time, the full-color toner image formed on the intermediate transfer belt 50 is transferred onto a recording sheet altogether in a secondary transfer nip between the secondary transfer roller 80 and the facing roller 73 in a secondary transfer unit. The recording sheet on which the full-color toner image is transferred is conveyed into a fixing unit 91, heated and pressed in the fixing unit 91, and ejected out of the printer.

Only the image forming unit 1Y will now be explained with reference to FIG. 11 because each of the image forming units 1Y, 1M, 10, and 1K has the same structure.

The image forming unit 1Y includes a photosensitive element 11 that is an image carrier, a charging unit 21 that charges the surface of the photosensitive element 11 with a charging roller, a developing unit 31 that is an image developing unit that develops an image formed on the photosensitive element 11 into a toner image, a first transfer roller 61 that transfers a latent image carrier onto the intermediate transfer belt 50, and a photosensitive element cleaning unit 41 that cleans the toner remaining on the surface of the photosensitive element 11.

The charging unit 21 has a structure that applies a voltage that is an AC voltage superimposed on a DC voltage to the charging roller that is a roller-shaped elastic conductive element. The photosensitive element 11 is charged to a predetermined polarity, for example, a negative polarity, by inducing direct discharge between the charging roller and the photosensitive element 11. The charged surface of each of the photosensitive elements 11 is irradiated with a laser beam L that is optically modulated and output from an image writing unit not illustrated. In this manner, an electrostatic latent image is formed on the surface of each of the photosensitive elements 11. In other words, an electrostatic latent image is formed as parts where the absolute value of the potential is reduced on the surface of the photosensitive element by being irradiated with the laser beam.

The first transfer roller 61 is a conductive elastic roller, and is arranged in a manner being pressed against the photosensitive element 11 from the rear side of the intermediate transfer belt 50. A bias applied with the constant current control is applied to the elastic roller as a primary transfer bias.

The photosensitive element cleaning unit 41 includes a cleaning blade 41*a* and a cleaning brush 41*b*. The cleaning blade 41*a* cleans the surface of the photosensitive element 11 in a counter direction with respect to the direction of a rotation of the photosensitive element 11 by being kept abutting against the photosensitive element 11, and the cleaning brush 41*b* cleans the surface of the photosensitive element 11 by being rotated in the counter direction of the rotation of the photosensitive element 11 while being kept in contact with the photosensitive element 11.

The developing unit 31 includes a container 31*c* filled with two-component developer containing Y toner and carrier, a developing sleeve 31*a* that is a developer carrier arranged inside of the container 31*c* in a manner facing the photosensitive element 11 via an opening on the container 31*c*, and a screw member 31*b* that is a stirring member arranged inside of the container 31*c* for stirring and conveying the developer.

The screw member 31*b* is arranged both on a side where developer is supplied, that is, a side near a developing sleeve, and on a side receiving the supply from a toner supplying unit not illustrated, and is supported rotatably on the container 31*c* via a shaft bearing member not illustrated.

Figure 11:
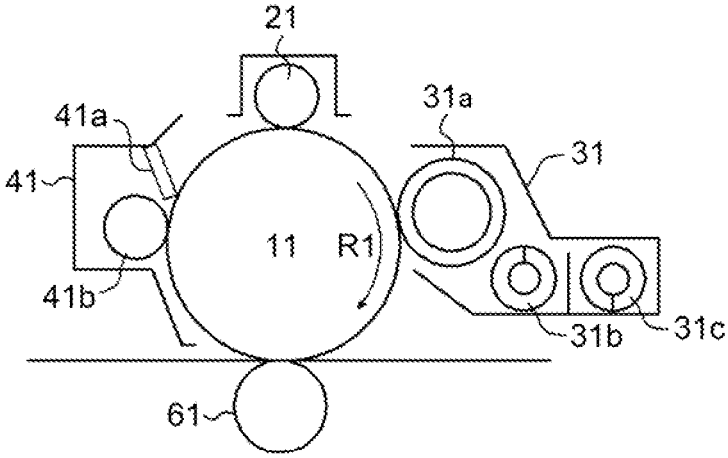
FIG. 11 is a schematic illustrating a structure of an image forming unit included in the image forming apparatus.

The photosensitive element 11 in each of the four image forming units is driven in rotation by a photosensitive element driving unit not illustrated in the clockwise direction in FIG. 11. The photosensitive element 11K for the black color and the photosensitive elements 11Y, 11M, and 11C for the other colors may be configured to be independently driven in rotations. In this manner, for example, when a monochromatic image is to be formed, only the photosensitive element 11 for the black color can be driven in rotation, and when a color image is to be formed, four of the photosensitive elements 11Y, 11M, 11C, and 11K can be driven in rotation simultaneously. At this time, when a monochromatic image is to be formed, the intermediate transfer unit including the intermediate transfer belt 50 is partially reciprocated in a manner moving away from the photosensitive element 11Y, 11M, and 11C that are for the other colors.

The intermediate transfer belt 50 is an endless belt member having a moderate resistance, for example, and is stretched across the facing roller 73 and a plurality of supporting rollers such as supporting rollers 71 and 72 included in the secondary transfer unit. The intermediate transfer belt 50 can be carried endlessly in the counter clockwise direction in FIG. 10 by driving one of the supporting rollers in rotation.

The supporting roller 72 is grounded, and a surface electrometer 75 is arranged in the manner facing the supporting roller 72. The surface electrometer 75 measures the potential of the surface when the toner image transferred onto the intermediate transfer belt 50 is carried across the supporting roller 72.

The facing roller 73 in the secondary transfer unit is connected to the power source 110 for applying the transfer bias. The power source 110 is capable of superimposing a DC voltage on an AC voltage and applying the resultant voltage, and can perform the constant current control to Ipp and Ioff of the voltage before being applied. By applying the voltage to the facing roller 73 in the secondary transfer unit, a potential difference is generated between the facing roller 73 and the secondary transfer roller 80, thus generating a voltage causing the toner to move from the intermediate transfer element 50 onto the recording sheet. In this manner, the toner image can be transferred onto the recording sheet.

The results of a research conducted using the image forming apparatus according to the embodiment will now be explained with reference to the accompanying drawings.

To begin with, Ipp was fixed to 2.8 [milliamperes], and the direct current that is to be superimposed is fixed to −16 [microamperes]. A solid black image was then output onto a sheet of standard paper at the AC voltage frequency of 282 [mm/s] and the linear velocity of the intermediate transfer belt at 141 [mm/s]. The inventor then checked for the frequencies at which no image unevenness was caused in the granularity of 100 [hertz] from 100 [hertz] to 700 [hertz], to find out that the image unevenness caused by a frequency would not occur when the frequency is at 400 hertz or higher at a linear velocity v of 282 mm/s, and when the frequency is 200 hertz or higher at a linear velocity v of 141 mm/s. The linear velocity of the intermediate transfer belt and the linear velocity of the recording sheet are nearly equal.

The reason why a different frequency is required for a certain linear velocity is related to time for which the transfer voltage is applied. When the nip width between the secondary transfer facing roller 73 and the secondary transfer roller 80 without any paper sheet being conveyed is d [millimeters], the time required for a paper sheet to pass through the nip can be expressed as d/v [seconds] using the linear velocity v and the nip width. When the frequency is at f [hertz], the cycle of the AC voltage will be 1/f [seconds]. Therefore, the number of the AC voltage cycles applied while the paper sheet passes through the nip can be expressed as d*f/v [cycles]. Because the nip width d in this embodiment is approximately 3 millimeters and a frequency of 400 hertz is required when the linear velocity is 282 [mm/s], the number of the AC voltage cycles needs to be applied will be 3*400/282≈4.255. Therefore, when the AC voltage is applied for approximately 4.25 cycles, an image without unevenness can be achieved. When the linear velocity is 141 [mm/s], the number of the AC voltage cycles needs to be applied 3*200/141≈4.255, which gives a good result as well, as the same number of alternative voltage is applied. Because 3*300/282≈3.191 when the frequency is 300 hertz and the linear velocity is 282 [mm/s], high quality images without any unevenness can be achieved if at least four cycles of the AC voltage are applied while the paper sheet passes through the nip. Thus, 4<d*f/v can be defined. Therefore, the frequency of the AC voltage to be applied preferably satisfies the relation represented as Equation (2) below.

$$f>(4/d)*v \quad (2)$$

The frequency was then fixed to 500 [hertz], and the linear velocity was fixed to 282 [mm/s]. A solid black image is then output onto Resack 66_260 kg that is paper manufactured by Tokushu Paper Manufacturing Co., Ltd., (paper with a thickness of approximately 320 micrometers and on which the difference between the recessed parts and the projected parts is approximately 130 micrometers at most). In the embodiment, the amount of toner attached to the solid black image on the intermediate transfer belt was 0.55 [mg/cm$^2$], and the electric charge of the toner Q/M was −30 [μC/g]. Because the width of the solid black image in this embodiment along the width direction of the secondary transfer roller is 0.28 meters, Itoner=−13.03 [microamperes] is obtained based on Equation (1). The constant current control was then performed to the output voltage of the power source 110, and the image was output while changing the current settings between −10 [microamperes] and −25 [microamperes] for Ioff, and between 2.0 [milliamperes] to 4.0 [milliamperes] for Ipp. The image is then visually evaluated. Because the paper Resack 66_260 kg has a highly textured surface, evaluations were conducted especially paying attention on the degree how the grooves were filled up and how the white splotches were formed along the grooves. The paper Resack 66_260 kg was denoted as a recording sheet A, and evaluations were made in following three levels:

o: satisfactory, Δ: slightly problematic, and x: problematic

Figure 12:
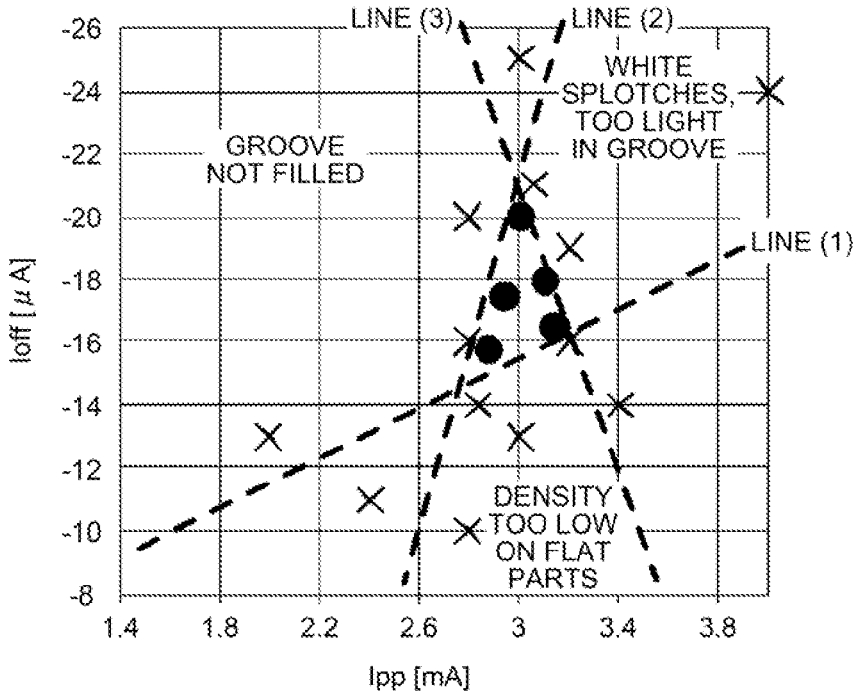
FIG. 12 is a schematic of results of a transferability evaluation test conducted by the inventors of the embodiment.
Figure 13:
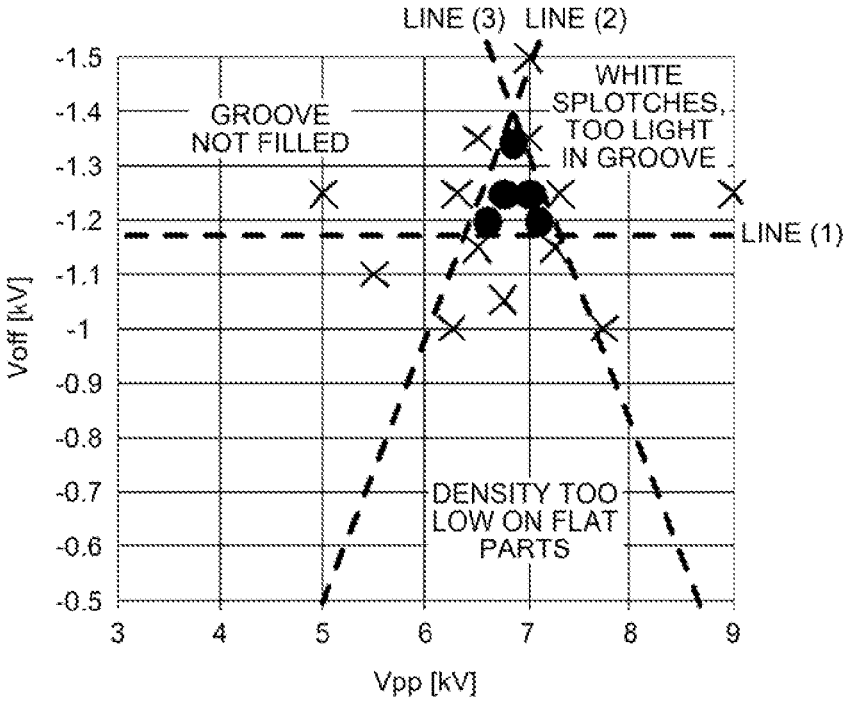
FIG. 13 is a schematic of a relation between images and average Vpp and Voff output from the power source.
Figure 14:
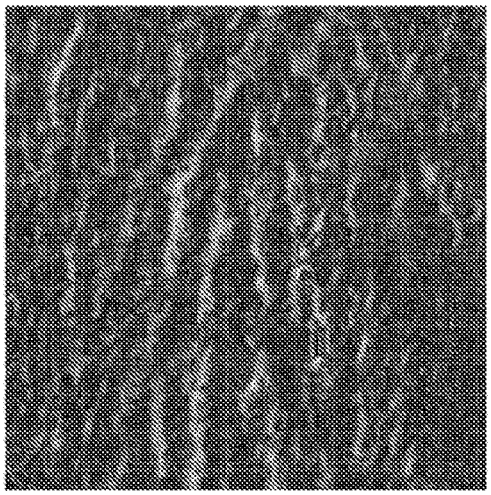
FIG. 14 is a schematic of an exemplary image where recessed parts on a paper sheet are not sufficiently filled with toner.
Figure 15:
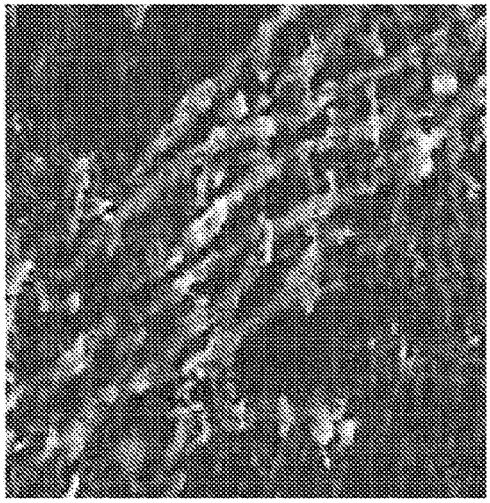
FIG. 15 is a schematic of an exemplary image in which white splotches are formed.
Figure 16:
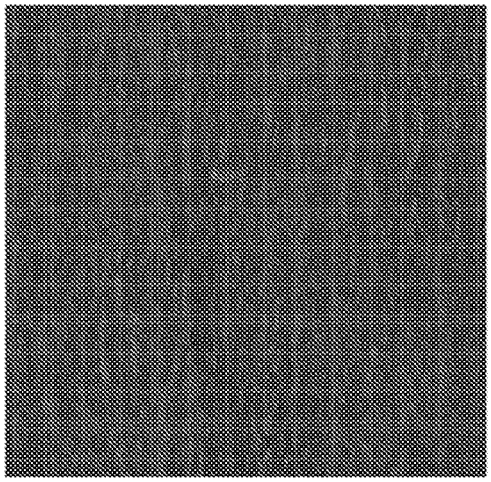
FIG. 16 is a schematic of an example of a high quality image.

The evaluation results are indicated in FIG. 12. There was a tendency in the problematic images. In an area below a dotted line (1) (the lower side of Voff) illustrated in FIG. 12, the image density was too low on the smooth parts. In the area on the left side of a dotted line (2) (the lower side of Vpp), recessed parts were not sufficiently filled. An example of an image in which recessed parts were not fully filled is illustrated in FIG. 14. On the right side of a dotted line (3) (the higher side of Vpp), white streaks, probably resulting from discharge, were formed. An example of an image on which white streaks were formed is illustrated in FIG. 15. Depending on toner conditions, the recessed parts may have low density, instead of completely white splotches being formed in the manner illustrated in FIG. 15. High quality images were formed in an area surrounded by the three dotted lines (1), (2), and (3). An example of a high quality image is illustrated in FIG. 16. Each of the images illustrated in FIGS. 14 to 16 is a square having a size of approximately 2.5 centimeters by 2.5 centimeters. The relation between the images and the average Vpp and Voff output from the power source and kept monitored while the images were formed is illustrated in FIG. 13. The lines (1), (2), and (3) can be drawn in the same manner as in the relation between the current and the images illustrated in FIG. 12. In a similar manner, the image density was too low on the smooth parts in the area below the dotted line (1), the recessed parts were not fully filled in the area on the left side of the dotted line (2), and white streaks were formed in the area on the right side of the dotted line (3).

Figure 17:
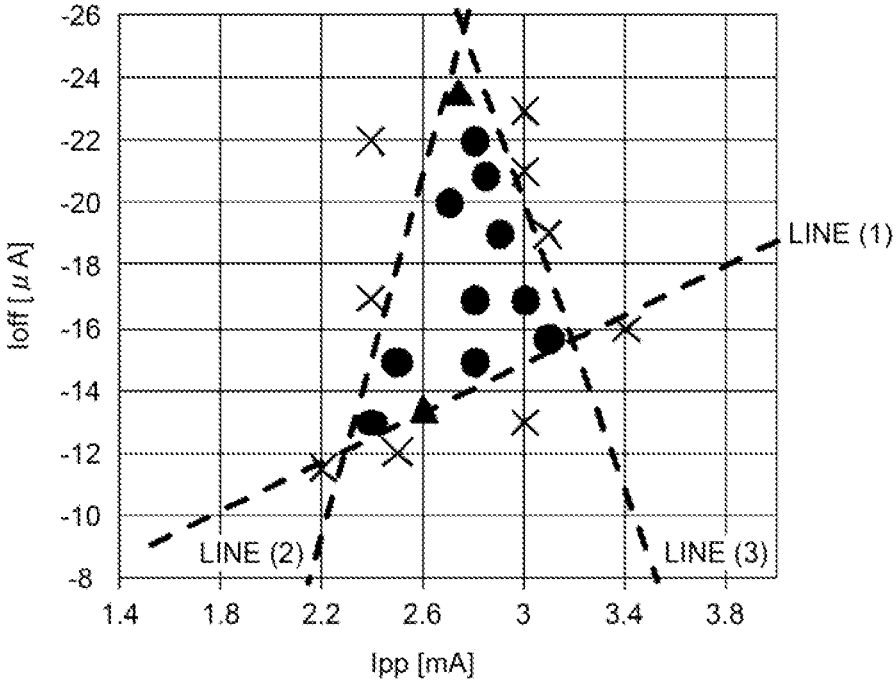
FIG. 17 is a schematic of results of a transferability evaluation test conducted with different paper.
Figure 18:
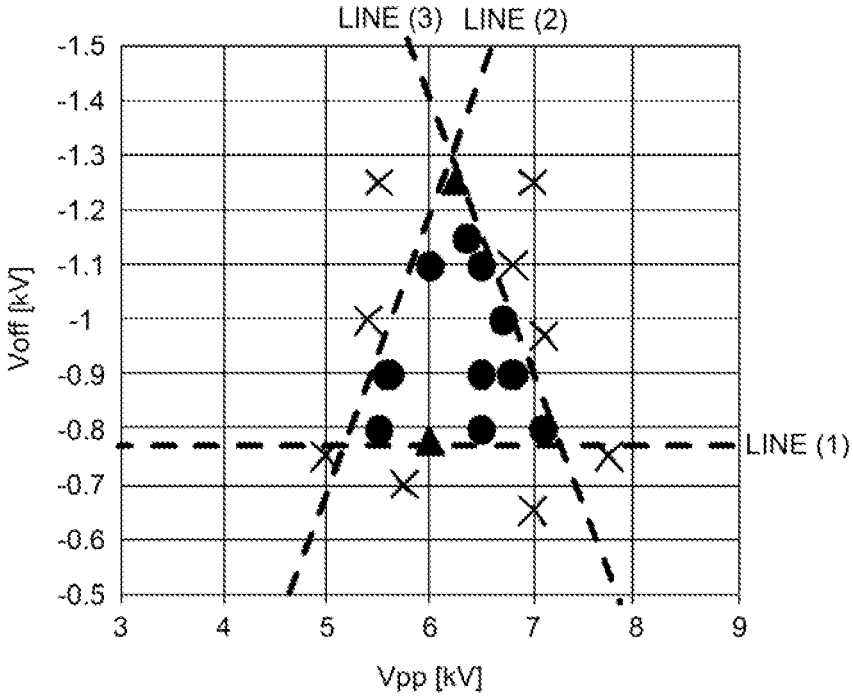
FIG. 18 is a schematic of a relation between the images and average Vpp and Voff output from the power source while the images were output.

Similar evaluations were then conducted using Resack 66_175 kg paper that is paper manufactured by Tokushu Paper Manufacturing Co., Ltd., (with a thickness of approximately 210 micrometers, and on which the difference between the recessed parts and the projected parts is approximately 120 micrometers at most) as a recording sheet B. Ioff was changed between −11 [microamperes] and −23 [microamperes], and Ipp was changed between 2.2 [milliamperes] and 3.4 [milliamperes]. The results of the evaluations are illustrated in FIG. 17. The relation between the images and the average Vpp and Voff output from the power source while the images were formed is illustrated in FIG. 18. The same kind of tendency can be observed in the problematic images as those found in the Resack 66_260 kg paper, and high quality images were achieved in the area surrounded by the three dotted lines (1), (2), and (3).

Figure 19:
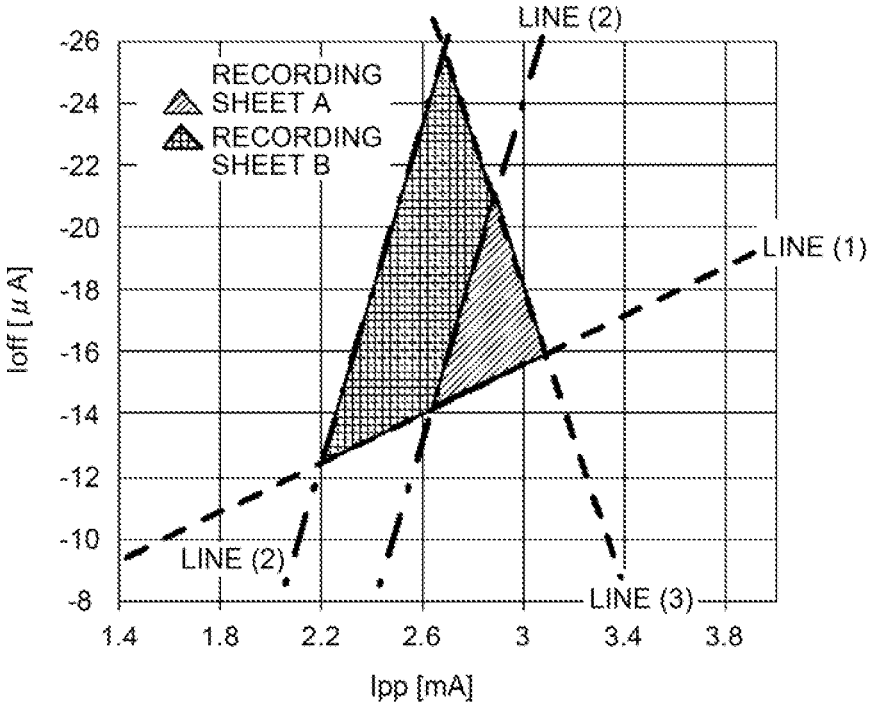
FIG. 19 is a schematic of a comparison of effective Ipp and Ioff for two types of paper.
Figure 20:
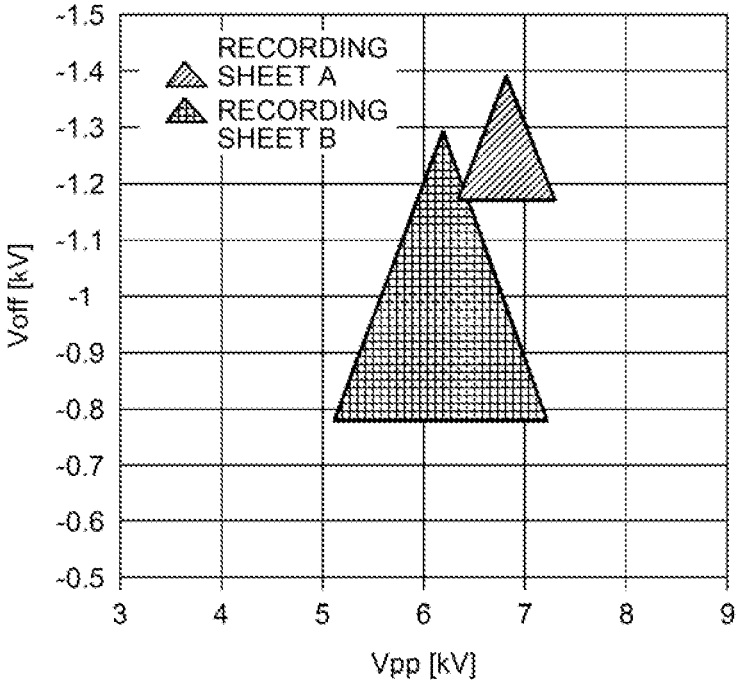
FIG. 20 is a schematic of a comparison of effective Vpp and Voff for the two types of paper.

FIG. 19 illustrates a comparison of Ipp and Ioff ranges that are effective for the two types of paper sheets A and B. FIG. 20 gives a comparison of effective Vpp and Voff ranges. Although the effective ranges were different among these different types of recording sheets, in the relation between the currents and the images illustrated in FIG. 19, the area representing high transferability for a recording sheet with more limited effective current ranges is almost completely covered by the area representing high transferability for the other recording sheet with larger effective current ranges. In this manner, when the output voltage is controlled by the constant current control using Ipp and Ioff, by determining settings for achieving high quality images on a recording sheet resulted in a narrower effective current ranges, high quality images can be achieved on any other types of recording sheets. On the contrary, in the relation between the voltages and the images illustrated in FIG. 20, the effective ranges differ depending on the recording sheets, and there are sections of effective ranges that are not covered by the others. Based on these, when the constant voltage control is to be performed using Vpp and Voff, the voltage settings must be changed for each type of recording sheets, and therefore, usability of the product is reduced. Furthermore, it is difficult to cope with an unknown type of recording sheets.

When the constant voltage control is performed, although the voltage output from the power source is kept constant, the intensity of an electrical field applied to the toner changes because the resistance changes depending on a recording sheet. Therefore, the area representing acceptable densities on the smooth parts illustrated in FIG. 20 will become different depending on the recording sheets. On the contrary, in the constant current control, as illustrated in FIG. 19, because the applied voltage is changed depending on the resistance of the recording sheet, the dotted line (1) indicating the acceptable densities on the smooth parts remains the same. The dotted line (3) suggesting formation of white streaks resulting from discharge also changes in the voltages applied, depending on the recording sheets. On the contrary, in the constant current control, the dotted line (3) does not change depending on the recording sheet. When a recording sheet with shallower recessed parts is used, the dotted line (2) indicating the acceptable degree of toner filling in the recessed parts is shifted to the lower side of Ipp and Vpp.

In the manner described above, in the constant current control, the dotted line (1) representing the acceptable densities on the smooth parts and the dotted line (3) representing formations of white streaks caused by discharge remain the same across the different types of paper or resistances. Therefore, by setting Ipp and Ioff within the ranges that are effective for a recording sheet with the lowest transferability, high transferability can be achieved on all recording sheets. For example, in this embodiment, by setting Ioff to −18 [microamperes] and setting Ipp to 2.8 [milliamperes] to 3.0 [milliamperes], high transferability can be achieved on a paper sheet with a textured surface.

The power source 110 was then changed to a power source that performs the constant current control to the DC component, and that performs the constant voltage control to the AC component, and images were output. The results obtained by setting Ioff to −16 [microamperes] and changing Vpp are provided in Table 1.

TABLE 1

| Vpp [kV] | 4 | 5 | 6 | 7 | 8 | 9 |
|---|---|---|---|---|---|---|
| Recording sheet A | x | x | x | ○ | x | x |
| Recording sheet B | x | x | ○ | ○ | x | x |

As indicated in Table 1, by performing the constant current control in a manner keeping Ioff at an appropriate level, even when the constant voltage control is applied to the AC component, a setting for achieving high quality images on different types of paper can be selected. When the constant voltage control is applied to the AC component, the structures for detecting the alternating current can be omitted. Therefore, the controlling structure can be simplified compared with that when the constant current control is performed.

In this manner, by applying the constant current control to the output voltage using Ioff, or Ioff and Ipp, images can be stably transferred onto recessed parts at high transferability depending on types of transfer media.

Figure 21:
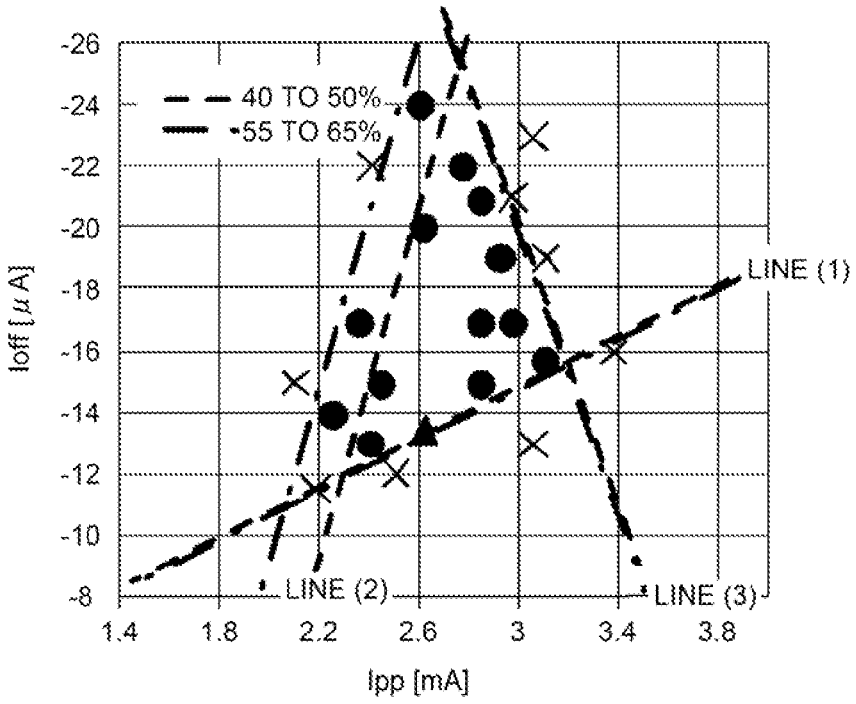
FIG. 21 is a schematic of a relation between images and currents in transferability evaluation tests conducted with different environmental conditions.
Figure 22:
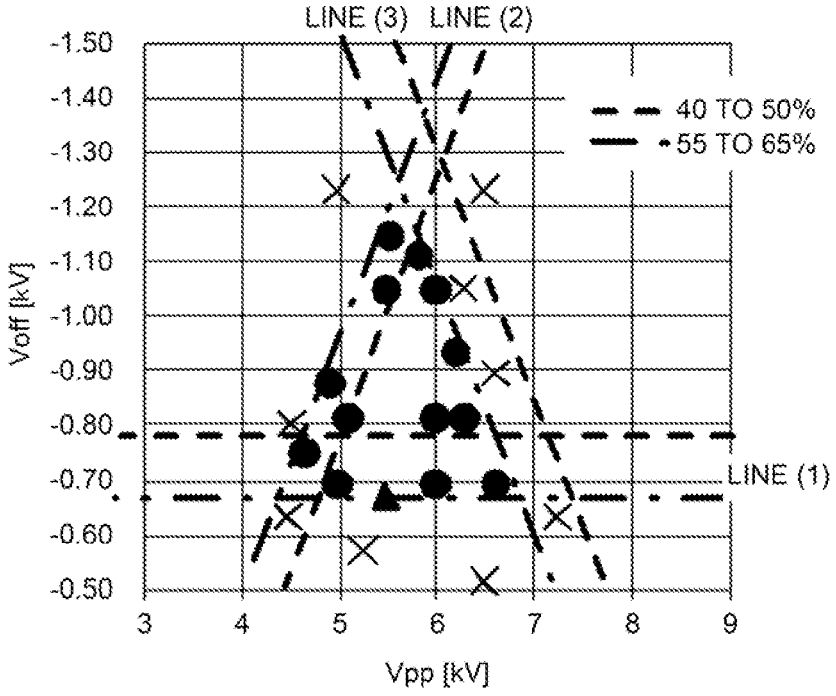
FIG. 22 is a schematic of a relation between images and voltages in transferability evaluation tests conducted with different environmental conditions.

Images were then output under different humidity. The results of image outputs described above were obtained in a humidity environment of 40 percent to 50 percent. Explained below are the results of the same evaluation conducted for the recording sheet B in a humidity environment of 55 percent to 65 percent. Used as the power source 110 was a power source outputting a voltage having both of the DC component and the AC component controlled by the constant current control. A relation between the currents and the images is illustrated in FIG. 21, and a relation between the voltages and the images is illustrated in FIG. 22. The dotted line represents the ranges where high quality images were achieved in the humidity of 40 percent to 50 percent, the long dashed short dashed line represents the ranges where high quality images were achieved in the humidity of 55 percent to 65 percent. When the humidity rises, the entire effective voltage ranges were shifted, as illustrated in FIG. 22. Therefore, if the voltage is fixed by means of the constant voltage control, there is a higher risk of not being able to achieve high quality images when the humidity changes largely. On the contrary, the effective current ranges changed less, as illustrated in FIG. 21. Therefore, current settings for achieving high quality images can be selected even when the humidity changes. In this manner, by applying the constant current control to the output voltage in which the DC component is superimposed on the AC component, image formations on the recessed parts can be performed at high quality transferability in a stable manner even if humidity changes. The same advantageous effects can be achieved for the humidity changes as those achieved in the experiment with different types of papers, by applying the constant current control to the DC component and applying the constant voltage control to the AC component.

Evaluations were then conducted with different velocities v at which the recording sheet B is conveyed. Used as the power source 110 was a power source outputting a voltage in which both of the DC component and the AC component are controlled by the constant current control. When the velocity v for conveying the recording sheet B is reduced to a half, Itoner will be reduced to a half as well, based on Equation (1) mentioned above. Table 2 indicates the results of image evaluations conducted by setting Ioff to −8 [microamperes] that is half the experiment result mentioned above while changing Ipp. A condition 1 and a condition 2 mentioned in Table 2 are as follows:

Condition 1: conveying velocity v=282 [mm/s] and Ioff=−16 [microamperes]

Condition 2: conveying velocity v=141 [mm/s], and Ioff=−8 [microamperes]

TABLE 2

| Ipp [mA] | 2.0 | 2.2 | 2.4 | 2.6 | 2.8 | 3.0 | 3.2 | 3.4 |
|---|---|---|---|---|---|---|---|---|
| Condition 1 | x | x | Δ | ○ | ○ | Δ | x | x |
| Condition 2 | x | Δ | ○ | ○ | Δ | x | x | x |

The same tendency can be achieved under different velocities by setting Ioff in a manner being proportional to the transfer medium conveying velocity. Therefore, by changing the DC component used in the constant current control correspondingly to the conveying velocity of the transfer medium, transferability to the recessed parts of the transfer medium can be achieved in a stable manner even in a transfer unit having modes with different velocities.

Evaluations were then conducted using a different amount of toner attached to the transfer belt. Used as the power source 110 was a power source outputting a voltage in which both of the DC component and the AC component are controlled by the constant current control. A paper conveying velocity of 282 mm/s and the recording sheet B were used. For a color image with M/A=0.88 [mg/cm$^2$], the amount of attached toner was M/A=0.55 [mg/cm$^2$] in the evaluations explained above. Therefore, M/A was 1.6 times the result of the previous evaluations. Because Itoner is proportional to M/A based on Equation (1), Ioff was set to −26 [microamperes] that is 1.6 times the value used in the previous evaluations, and image evaluations were conducted using different Ipp. The results are indicated in Table 3. A condition 3 and a condition 4 mentioned in Table 3 are as follows:

Condition 3: M/A=0.55 [mg/cm$^2$], Ioff=−16 [microamperes]

Condition 4: M/A=0.88 [mg/cm$^2$], Ioff=−26 [microamperes]

TABLE 3

| Ipp [mA] | 2.0 | 2.2 | 2.4 | 2.6 | 2.8 | 3.0 | 3.2 | 3.4 |
|---|---|---|---|---|---|---|---|---|
| Condition 3 | x | x | Δ | ○ | ○ | Δ | x | x |
| Condition 4 | x | x | x | x | x | Δ | ○ | x |

By setting Ioff proportional to the amount of attached toner, conditions for enabling high quality images to be achieved can be obtained simply by assigning Ipp. Based on researches conducted by the inventors, it has been confirmed that, when the amount of attached toner and the electric charge of the toner increase, optimal Ipp increases along with an increased lower boundary of Ioff. Therefore, optimal Ipp conditions for different amounts of attached toner and different electric charges of the toner may be examined in advance, and a data table based on experiment results may be stored in a memory. A function may then be added so that Ipp is determined when the amount of attached toner and the electric charge of the toner change. In this manner, the settings to be used in the constant current control may be determined automatically depending on the conditions of the amount of attached toner and the electric charge of the toner. Therefore, by changing the settings used in the constant current control applied to the DC component depending on the amount of toner attached on the image carrier, stable transferability to the recessed parts of a transfer medium can be achieved even across images with very different amounts of attached toner, such as a monochromatic image and a color image. It has been confirmed that, when the amount of attached toner and the electric charge of the toner increase, the ranges of currents for enabling high quality images themselves become narrower, and the optimal Ipp increases as Ioff increases, as mentioned earlier. When the amount of toner attached is extremely high, for example, in the graph illustrating the relation between the voltages or the currents and the images, the effective area represented in the shape of a triangle, surrounded by the line (1) indicating the acceptable densities on the smooth parts, the line (2) indicating the acceptable degree of filling of the recessed parts with the toner, and the line (3) indicating the formations of white streaks caused by discharge, might not be formed. However, on a recording sheet with deep recessed parts, although some white splotches may be formed in images, the transferability to the recessed part is higher than that achieved by the conventional transfer in which only the DC voltage is used in transferring. Therefore, the effects of improving the transferability on the recessed parts can be achieved in the ranges other than effective ranges explained above.

When an AC/DC superimposed bias is applied to the secondary transfer unit, in the structure illustrated in FIG. 10, the controlled voltage is applied to the core metal in the facing roller 73 (facing member). However, in practice, because an object is to generate a potential difference in the transfer nip (transfer unit), when the resistance in the resistance layer (resin parts such as rubber or sponge) on the facing roller changes, simply by controlling the potential of the core metal in the facing roller, a desired potential difference cannot be generated in the transfer nip.

In response to this issue, to ensure that a potential difference near an ideal is generated in the transfer nip, a constant current may be applied to the transfer unit without any paper (or with paper), and the resistance in the secondary transfer unit (the facing roller 73, the transfer belt 50, and the transfer roller 80) may be measured based on the voltage required at that time, and the AC/DC superimposed voltage may be applied based on the measurement.

To obtain the voltage to be applied to the transfer unit based on the resistance thus measured, the voltage to be applied may be directly obtained from the resistance of the transfer unit, or resistances may be classified using a certain threshold, and the voltage to be applied may be obtained based on the table.

A desired potential difference cannot be generated in the transfer nip when the resistance in the members included in the transfer unit changes not only in the configuration illustrated in FIG. 10 (FIG. 3), but also in a configuration in which a bias is applied in a different approach (e.g., the configuration illustrated in FIG. 1). However, following explanations are made based on the structure illustrated in FIG. 10.

Explained below is an example of a method for correcting the voltage to be applied when the resistance and the like in the secondary transfer unit changes. In the explanation of the correction method below, the constant current control is applied to the DC component, and the constant voltage control is applied to the AC component. However, the embodiment is not limited thereto. Either one of the DC component and the AC component may be controlled by the constant current control or the constant voltage control. In such cases as well, the electrical field to be applied can be obtained from the resistance of the secondary transfer unit, except different correction coefficients are used.

Regardless of how these controls are combined, the DC component and the AC component need to be corrected separately. The reason is as follows. Almost all of the DC component in the applied current flows from the facing roller 73 to the paper and the transfer roller 80. On the contrary, in the AC component, because the polarity changes quickly, almost all of the current is consumed in charging the facing roller 73 or the transfer roller 80, and only a part of the applied current flows from the facing roller 73 to the paper and the transfer roller 80. Specifically, the DC component current applied in this example is −10 microamperes to −100 microamperes, and the AC component current of ±0.5 milliamperes to ±10 milliamperes is applied.

As this exemplary correction method, in "Resistance Correction Coefficient Table" illustrated in Table 4 below, the table is divided into six rows using five resistance thresholds. R−2 to R+3 (R0 as a standard) are set in the ascending order of the resistance, and a correction ratio (correction coefficient) is determined for each.

TABLE 4

Resistance correction coefficient table

| Name | | | |
|---|---|---|---|
| Subclassifications | Sub-subclassification | Coefficients for AC component | Coefficients for DC component |
| Secondary transfer: Resistance correction coefficients | R − 2 | 81% | 117% |
| Secondary transfer: Resistance correction coefficients | R − 1 | 90% | 112% |
| Secondary transfer: Resistance correction coefficients | R0 | 100% | 108% |
| Secondary transfer: Resistance correction coefficients | R + 1 | 115% | 105% |
| Secondary transfer: Resistance correction coefficients | R + 2 | 120% | 103% |
| Secondary transfer: Resistance correction coefficients | R + 3 | 260% | 102% |

In Table 4, there is an opposite tendency in an increase and a decrease of the coefficients between the DC component and the AC component. This is because of the difference between the constant voltage control and the constant current control explained earlier.

In the constant current control, because the current passing through the transfer nip is controlled, when the resistance of the facing roller 73 decreases, the potential difference generated in the transfer nip is reduced as well. Therefore, the potential difference generated in the transfer nip will not be constant unless the controlled current is increased.

On the contrary, in the constant voltage control, because the voltage at the core metal in the facing roller 73 is controlled, the potential difference in the transfer nip will have its voltage reduced in the rubber layer of the facing roller 73. Therefore, when the resistance of the facing roller 73 decreases, the potential difference generated in the transfer nip will increase. Hence, the potential difference generated in the transfer nip will not be constant unless the controlled voltage is decreased.

By using the correction coefficients provided in "Resistance Correction Coefficient Table", the same transferability can be achieved even when the resistance of the secondary transfer unit changes. The correction coefficients provided in the Table 4 are merely examples used in the embodiment, and these correction coefficients are changed when the system is changed.

The electrical field to be applied to the facing roller 73 will also be different depending on the moisture contained in the paper. This is because the electrical resistance of the paper decreases when the moisture in the paper increases. When the electrical resistance of the paper decreases, the potential difference to be generated in the transfer nip is reduced.

For example, in "Humidity Environment Correction Coefficient Table" provided in Table 5, the temperature and humidity in the image forming apparatus are measured, five thresholds are set for the absolute humidity obtained from the measurements, and a table is divided into six rows using these thresholds. LLL, LL, ML, MM, MH, and HH are set in the ascending order of the humidity, and a correction ratio (correction coefficient) is determined for each.

TABLE 5

Humidity environment correction coefficient table

| Name | | | |
|---|---|---|---|
| Subclassifications | Sub-subclassification | Coefficients for AC component | Coefficients for DC component |
| Secondary transfer: Environment correction coefficients | LLL | 127% | 105% |
| Secondary transfer: Environment correction coefficients | LL | 121% | 105% |
| Secondary transfer: Environment correction coefficients | ML | 113% | 100% |
| Secondary transfer: Environment correction coefficients | MM | 100% | 100% |
| Secondary transfer: Environment correction coefficients | MH | 80% | 90% |
| Secondary transfer: Environment correction coefficients | HH | 60% | 85% |

Because the temperature and humidity environment coefficients are intended to correct a resistance change in the paper in the transfer nip, the tendency of a coefficient increase and decrease is the same between the constant voltage control and the constant current control.

As explained above, by controlling the electrical field applied to the facing roller 73, constant transferability can be achieved even when a cause of errors change.

The effects achieved when the constant current control is applied to the AC component in the superimposed transfer bias will now be explained with some comparative examples.

In a transfer performed with the application of an AC/DC superimposed voltage, when the paper becomes thicker, a larger potential difference needs to be generated in the transfer nip.

When the constant current control is applied to the AC component, the electrical charge supplied to the facing roller 73 will remain constant. Furthermore, if the paper passing through the nip is thicker, the capacity of the transfer unit as a capacitor decreases (because the distance increases). Hence, the potential difference generated in the transfer nip will increase. Therefore, even if the paper thickness is changed, the same transferability can be achieved without changing the target current by a large degree.

An example will now be described on a method of correcting the AC electrical field to be applied when the thickness of the recording sheet is changed. In this example, a correction method used when the constant current control is applied to the AC component is explained as an example of the embodiment, and an example in which the constant voltage control is applied to the AC component is explained as a comparative example. The number of thresholds (the number of rows in the table) or the correction ratios (coefficients) are just examples, and the embodiment is not limited thereto.

For example, in "Paper Thickness Correction Coefficient Table" provided in Table 6, six thresholds are set to the paper thickness to create a table with seven rows, and paper thicknesses 1 to 7 are specified in the ascending order of the paper thickness, and a correction ratio (correction coefficient) is determined for each thickness.

TABLE 6

Paper thickness correction coefficient table

| Name | | | |
|---|---|---|---|
| Subclassifications | Sub-subclassification | Constant voltage control | Constant current control |
| Secondary transfer: Paper thickness correction coefficients | Paper thickness 1 | 100% | 100% |
| Secondary transfer: Paper thickness correction coefficients | Paper thickness 2 | 115% | 102% |
| Secondary transfer: Paper thickness correction coefficients | Paper thickness 3 | 131% | 105% |
| Secondary transfer: Paper thickness correction coefficients | Paper thickness 4 | 146% | 108% |
| Secondary transfer: Paper thickness correction coefficients | Paper thickness 5 | 162% | 109% |
| Secondary transfer: Paper thickness correction coefficients | Paper thickness 6 | 177% | 111% |
| Secondary transfer: Paper thickness correction coefficients | Paper thickness 7 | 193% | 114% |

As indicated in "Paper Thickness Correction Coefficient Table", when the constant current control is applied to the AC component, the correction ratios used for different paper thicknesses are much smaller compared with those used in the comparative example in which the constant voltage control is applied. In this manner, even if the paper thickness changes slightly due to variations in paper, constant transferability can be achieved without changing (correcting) the control value (correction ratio).

Furthermore, in a highly humid environment, because the paper absorbs the moisture and reduces the resistance, the potential difference generated in the transfer nip needs to be reduced.

In this example as well, because the electric permittivity increases due to a moisture increase in the paper passing through the nip, and causes an increase in the capacity of the transfer unit as a capacitor, when the same amount of electrical charge is supplied using the constant current control, the potential difference generated in the transfer nip will be smaller. Therefore, for the humidity changes as well, the same transferability can be achieved without changing the target current by a large degree.

Compared side by side in Table 7 below are the correction coefficients used in different humidity environments when the constant current control is applied to the AC component (the embodiment) and when the constant voltage control is applied (comparative example). The number of thresholds (the number of rows in the table) or the correction ratios (coefficients) are just examples, and the embodiment is not limited thereto.

TABLE 7

Humidity environment correction coefficient table

| Name | | | |
|---|---|---|---|
| Subclassifications | Sub-subclassification | Constant voltage control | Constant current control |
| Secondary transfer: Environment correction coefficients | LLL | 127% | 110% |
| Secondary transfer: Environment correction coefficients | LL | 121% | 108% |
| Secondary transfer: Environment correction coefficients | ML | 113% | 102% |
| Secondary transfer: Environment correction coefficients | MM | 100% | 100% |
| Secondary transfer: Environment correction coefficients | MH | 80% | 92% |
| Secondary transfer: Environment correction coefficients | HH | 60% | 87% |

As indicated in Table 7, when the constant current control is applied to the AC component, the correction ratios used for different environments are smaller compared with those used in the comparative example in which the constant voltage control is applied. In this manner, when the environment changes slightly, constant transferability can be achieved without changing (correcting) the control value (correction ratio).

Finally, an embodiment of an image forming apparatus having a different structure will be explained.

Figure 23:
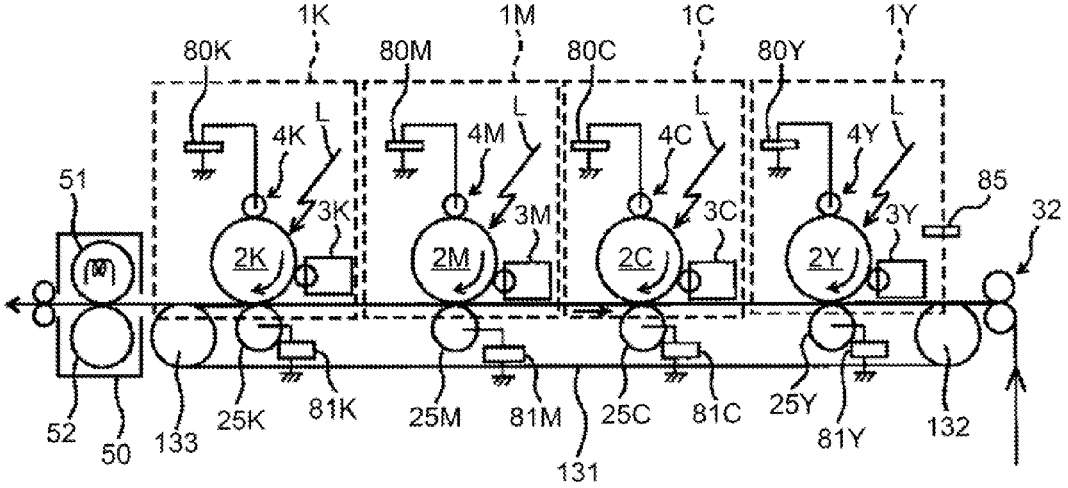
FIG. 23 is a schematic illustrating an exemplary structure of a direct transfer type color printer according to the embodiment.

The embodiment is not limited to an intermediate transfer type (indirect transfer type) color printer in which a toner image on the photosensitive element is transferred onto the intermediate transfer belt, and then further transferred onto a recording sheet, but is also applicable to a direct transfer type color printer in which a toner image on the photosensitive element is directly transferred onto a recording sheet, such as one illustrated in FIG. 23. In this direct transfer type color printer, a recording sheet is fed onto a conveyor belt 131 by a paper feeding roller 32, an image in each of the colors is sequentially transferred from a photosensitive element 2 (2Y, 2C, 2M, and 2K) for each of the colors directly onto the recording sheet, and is fixed by the fixing unit 50. By using an AC/DC superimposed voltage that is applied with the constant current control as a voltage to be applied to each of the transfer units, the same advantageous effects as those achieved by the (indirect transfer type) image forming apparatus according to the previous embodiment can be achieved. The recording sheet on which the images are fixed is ejected to an ejection tray not illustrated.

Figure 24:
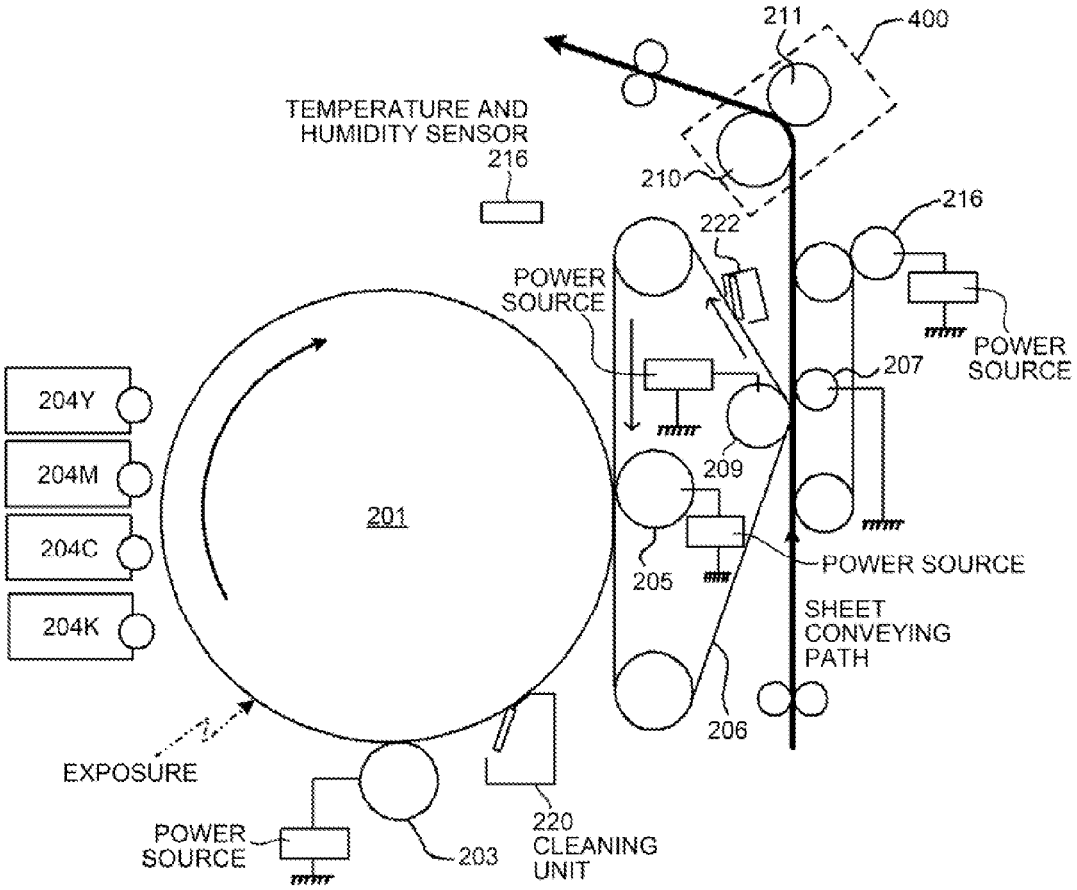
FIG. 24 is a schematic illustrating an exemplary structure of a single drum type color image forming apparatus according to the embodiment.

The embodiment is also applicable to a so-called single drum type color image forming apparatus, as illustrated in FIG. 24. The single drum type color image forming apparatus includes a charging unit 203, developing units 204 (Y, C, M, and K) respectively corresponding to the colors of yellow, cyan, magenta, and black, and the like arranged around a single photosensitive element 201. When an image is to be formed, the surface of the photosensitive element 201 is at first charged uniformly by the charging unit 203, and then irradiated with the laser beam L modulated with Y image data, to form a Y electrostatic latent image on the surface of the photosensitive element 201. The Y electrostatic latent image is then developed in a developing unit 204Y using Y toner. The Y toner image thus obtained is primarily transferred onto an intermediate transfer belt 206. The toner remaining on the surface of the photosensitive element 201 after the transfer is then removed by a cleaning unit 220, then the surface of the photosensitive element 201 is charged again uniformly by the charging unit 203. The surface of the photosensitive element 201 is then irradiated with a laser beam L modulated with M image data, to form an M electrostatic latent image on the surface of the photosensitive element 201. The M electrostatic latent image is then developed by a developing unit 204M using M toner. The M toner image thus obtained is primarily transferred onto the intermediate transfer belt 206 on the Y toner image that is primarily transferred to the intermediate transfer belt 206, and C and K toner images are primarily transferred onto the intermediate transfer belt 206 in the same manner. The toner images in each of the colors formed on the intermediate transfer belt 206 in a manner overlapping each other are then transferred onto a recording sheet that has been conveyed into the secondary transfer nip. At this time, by using an AC/DC superimposed voltage applied with the constant current control as a voltage to be applied to the transfer unit, the same advantageous effects as those achieved by the image forming apparatuses according to the embodiments described above can be achieved. The recording sheet having the toner images thus transferred is conveyed into a fixing unit 400. The recording sheet is then heated and pressed in the fixing unit 400 to fix the toner images onto the recording sheet. The recording sheet on which the images are fixed is ejected to an ejection tray not illustrated.

Figure 25:
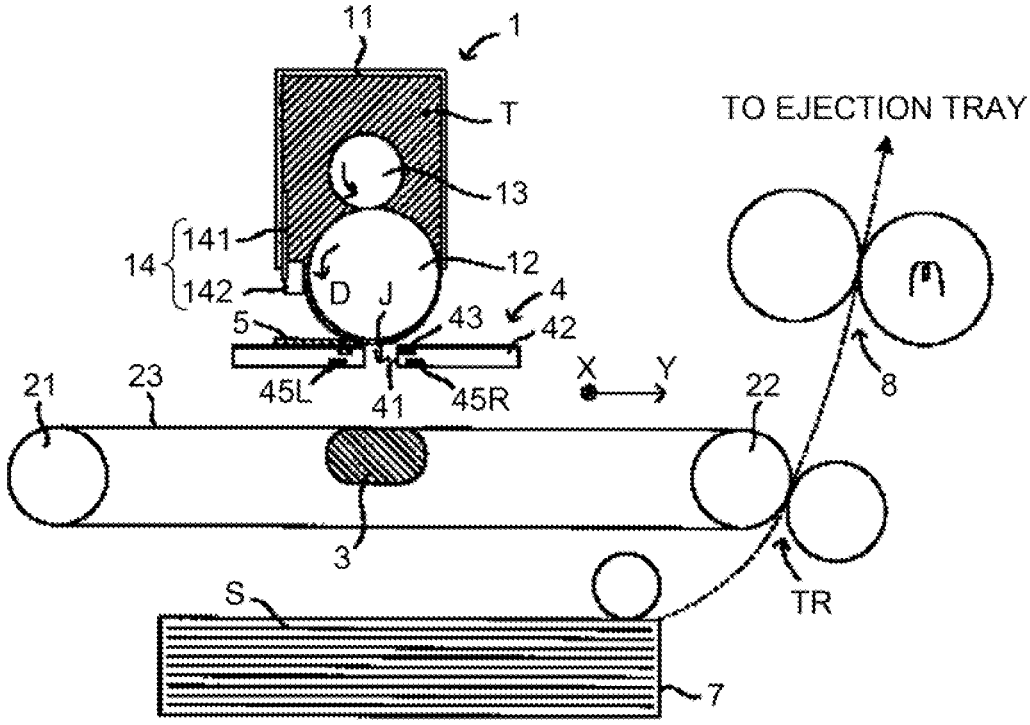
FIG. 25 is a schematic illustrating an exemplary structure of a toner jet image forming apparatus according to the embodiment.

FIG. 25 is a schematic illustrating a structure of an image forming unit included in an image forming apparatus disclosed in Japanese Patent Application Laid-open No. 2003-118158. The embodiment may also be applied to a toner jet image forming apparatus using the intermediate transfer. The image forming apparatus illustrated in FIG. 25 forms an image on an intermediate transfer belt 3 by means of a toner jet technique, and the image is transferred onto a recording sheet in a transfer area. At this time, by using an AC/DC superimposed voltage applied with the constant current control as a voltage to be applied, the same advantageous effects as those achieved by the image forming apparatuses according to the embodiments described above can be achieved. The recording sheet on which the toner images are thus transferred is conveyed into a fixing unit 8. The recording sheet is then heated and pressed in the fixing unit to fix the toner images onto the recording sheet, and to obtain an image.

In this manner, the transfer unit according to the embodiment can transfer an image onto different types of medium having some texture, regardless of the structures of the image forming apparatus, once a flat image can be formed using electrostatic powder.

As explained so far, the embodiment can achieve stable transferability to the recessed parts of a transfer medium even in environmental changes or differences in the transfer media, in an electrostatic toner transfer unit that applies a voltage having a DC component superimposed on an AC component, by performing the constant current control to the output voltage of the power source using Ioff, or Ioff and Ipp of the output current.

Furthermore, by changing the values used in the constant current control depending on the conveyance velocity of the transfer medium, the stable transferability can be achieved even on the recessed part of a transfer medium in a transfer unit having modes with different velocities.

Furthermore, by changing the values used in the constant current control depending on the amount of toner attached on the image carrier, the stable transferability to the recessed parts of a transfer medium can be achieved even in images in which the amount of attached toner is very different, such as a monochromatic image and a color image.

Furthermore, by allowing the voltage output from the power source to be selected between an output in which the DC is superimposed on the AC and an output having only the DC, the transfer can also be switched to a transfer using a DC voltage (in the same manner as in the conventional transfer).

Furthermore, by configuring a power source for applying only the DC, and a power source for applying a DC/AC superimposed voltage or applying only an AC separately, the latter power source can be easily added to an existing system using only the DC power source, in a switchable manner, so as to improve functions.

Furthermore, by arranging a power source for applying only the DC and a power source for applying a DC/AC superimposed voltage or only an AC separately on the side of the image carrier and on the side of the transfer medium, respectively, the space in a product can be used effectively, and downsizing of the product becomes possible, for example.

By combining the transfer unit according to the embodiment with different types of image forming apparatuses, the transfer unit can be used for different applications in which electrostatic particles are transferred onto a transfer medium having some texture.

The embodiment is explained using the example illustrated in the drawings, however, the embodiment is not limited thereto. For a structure of the transfer unit, an appropriate structure may be used within the scope of the embodiment. For a configuration of the power source for applying the transfer bias, an appropriate configuration may be used as well.

The image forming apparatus may be configured in any way. For example, the image forming unit in each of the colors in the tandem type image forming apparatus can be arranged in any order. Furthermore, not only the tandem type, but also a structure using a plurality of developing units arranged around a single photosensitive element, or a structure using a revolver type developing unit is also possible. The embodiment may also be applied to a full-color machine using toners in three colors, a multi-color machine using toners in two colors, or to a monochromatic apparatus. The image forming apparatus is obviously not limited to a printer, but may also be a multi-function product (MFP) having a plurality of functions.

In the structure according to another aspect of the present invention, a structure for detecting the alternating current is not required. Therefore, the controlling structure can be simplified.

In the structure according to still another aspect of the present invention, high transferability can be achieved for various types of recording sheets, and stable transfer can be performed even on highly textured paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

an image carrier configured to carry a toner image;

a transfer member configured to contact the image carrier via a recording medium;

a power source configured to output a transfer bias to transfer the toner image from the image carrier onto the recording medium at a transfer nip formed between the image carrier and the transfer member, the transfer bias having a direct current component and an alternating current (AC) component superimposed on the direct current component; and a controller configured to control the power source, wherein the controller controls a level of the direct current component output from the power source by a constant current control.

2. The transfer device according to claim 1, wherein the controller controls a level of the alternating current (AC) component output from the power source by a constant voltage control.

3. The transfer device according to claim 1, wherein the controller controls a level of the alternating current (AC) component output from the power source by the constant current control.

4. The transfer device according to claim 1, wherein the controller controls the level of the direct current component output from the power source depending on a conveyance velocity of the recording medium.

5. The transfer device according to claim 1, wherein the controller controls the level of the direct current component output from the power source depending on an amount of an attached toner attached on the image carrier.

6. The transfer device according to claim 1, wherein the power source is arranged in a manner selectively outputting a first transfer bias having only the direct current component and a second transfer bias having the direct current component and the alternating current (AC) component superimposed on the direct current component.

7. The transfer device according to claim 6, wherein the power source comprises a first power source unit configured to output only the direct current component, and a second power source unit configured to output the direct current component and the alternating current (AC) component, wherein the first power unit and the second power unit are provided separately.

8. The transfer device according to claim 6, wherein the power source comprises a first power source unit configured to output only the direct current component, and a second power source unit configured to output only the alternating current (AC) component, wherein the first power unit and the second power unit are provided separately.

9. The transfer device according to claim 7, wherein one of the first power unit and the second power unit is arranged on a side of the image carrier, and the other is arranged on a side of the transfer member.

10. The transfer device according to claim 8, wherein one of the first power unit and the second power unit is arranged on a side of the image carrier, and the other is arranged on a side of the transfer member.

11. An image forming apparatus comprising the transfer device according to claim 1.

12. The transfer device according to claim 1, wherein the controller controls a level of the alternating current (AC) component output and the level of the direct current component output separately.

13. A transfer device comprising:

an image carrier configured to carry a toner image;

a transfer member configured to contact the image carrier via a recording medium;

a power source configured to output a transfer bias to transfer the toner image from the image carrier onto the recording medium at a transfer nip formed between the image carrier and the transfer member, the transfer bias having a direct current component and an alternating current (AC) component superimposed on the direct current component; and a controller configured to control the power source, wherein the controller controls a level of the direct current component output from the power source by a constant current control, wherein the controller controls the level of the direct current component output from the power source depending on a resistance in a transfer unit including the image carrier and the transfer member.

14. The transfer device according to claim 13, wherein the controller controls a level of the alternating current (AC) component output from the power source depending on a thickness of the recording medium.

15. The transfer device according to claim 13, wherein the controller controls the level of the direct current component output from the power source depending on a temperature and a humidity in the transfer device.

16. The transfer device according to claim 13, wherein the controller controls a level of the alternating current (AC) component output from the power source depending on a temperature and a humidity in the transfer device.

17. A transfer device comprising:

an image carrier configured to carry a toner image;

a transfer member configured to contact the image carrier via a recording medium;

a power source configured to output a transfer bias to transfer the toner image from the image carrier onto the recording medium at a transfer nip formed between the image carrier and the transfer member, the transfer bias having a direct current component and an alternating current (AC) component superimposed on the direct current component; and a controller configured to control the power source, wherein the controller controls a level of the direct current component output from the power source by a constant current control, wherein the controller controls a level of the alternating current (AC) component output from the power source depending on a resistance in a transfer unit including the image carrier and the transfer member.

18. A transfer device comprising:

an image carrier configured to carry a toner image;

a transfer member configured to contact the image carrier via a recording sheet with a textured surface;

a power source configured to output a transfer bias to transfer the toner image from the image carrier onto the recording sheet at a transfer nip formed between the image carrier and the transfer member, the transfer bias having a direct current component and an alternating current (AC) component superimposed on the direct current component; and a controller configured to control the power source, wherein the controller controls a level of the direct current component output from the power source by a constant current control.

19. The transfer device according to claim 18, wherein the controller controls the power source so that a polarity of the transfer bias is alternatively changed while the recording sheet passes through the transfer nip.

* * * * *